US011739502B2

(12) United States Patent
Kumagai et al.

(10) Patent No.: US 11,739,502 B2
(45) Date of Patent: Aug. 29, 2023

(54) WORK MACHINE

(71) Applicant: Hitachi Construction Machinery Co., Ltd., Tokyo (JP)

(72) Inventors: Kento Kumagai, Ami-machi (JP); Shinya Imura, Toride (JP); Yasutaka Tsuruga, Ryugasaki (JP); Takaaki Chiba, Kasumigaura (JP); Hiroaki Amano, Tsukuba (JP); Shinji Nishikawa, Kasumigaura (JP); Akihiro Narazaki, Tsukuba (JP); Genroku Sugiyama, Tsuchiura (JP); Shinjiro Yamamoto, Ami-machi (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 17/641,038

(22) PCT Filed: Mar. 18, 2021

(86) PCT No.: PCT/JP2021/011253
§ 371 (c)(1),
(2) Date: Mar. 7, 2022

(87) PCT Pub. No.: WO2021/200244
PCT Pub. Date: Oct. 7, 2021

(65) Prior Publication Data

US 2022/0333348 A1 Oct. 20, 2022

(30) Foreign Application Priority Data

Mar. 30, 2020 (JP) ..... 2020-060813

(51) Int. Cl.
*E02F 9/22* (2006.01)
*F15B 11/024* (2006.01)
(Continued)

(52) U.S. Cl.
CPC ..... *E02F 9/2217* (2013.01); *E02F 9/2004* (2013.01); *E02F 9/2228* (2013.01);
(Continued)

(58) Field of Classification Search
CPC ..... F15B 11/024; F15B 2011/0243; F15B 2011/0246; F15B 21/14; F15B 2211/3058; E02F 9/2217
See application file for complete search history.

(56) References Cited

U.S. PATENT DOCUMENTS 5,479,778 A 1/1996 Toyooka et al.
5,835,874 A 11/1998 Hirata et al.
(Continued)

FOREIGN PATENT DOCUMENTS

JP 7-158604 A 6/1995
JP 3056254 B2 6/2000
(Continued)

OTHER PUBLICATIONS

International Search Report (PCT/ISA/210) issued in PCT Application No. PCT/JP2021/011253 dated Apr. 20, 2021 with English translation (four (4) pages).
(Continued)

*Primary Examiner* — Michael Leslie
(74) *Attorney, Agent, or Firm* — Crowell & Moring LLP

(57) ABSTRACT

Provided is a work machine which can increase the operation speed of an actuator by a regeneration function while securing the position control accuracy of the actuator. A controller is configured to calculate a regeneration flow rate on the basis of an input amount of an operation lever and a target actuator flow rate, subtract the regeneration flow rate from the target actuator flow rate to calculate a target actuator supply flow rate, calculate a target flow rate control valve opening amount on the basis of the target actuator
(Continued)

supply flow rate, calculate a target pump flow rate that is equal to or higher than a total target actuator supply flow rate, control a selector valve on the basis of the input amount of the operation lever, control a flow rate control valve according to the target flow rate control valve opening amount, and control a hydraulic pump according to the target pump flow rate.

4 Claims, 12 Drawing Sheets

(51) Int. Cl.
*E02F 9/20* (2006.01)
*F15B 13/02* (2006.01)

(52) U.S. Cl.
CPC ..... *E02F 9/2235* (2013.01); *F15B 11/024* (2013.01); *F15B 13/02* (2013.01); *E02F 9/2282* (2013.01); *E02F 9/2285* (2013.01); *E02F 9/2292* (2013.01); *E02F 9/2296* (2013.01); *F15B 2211/3058* (2013.01); *F15B 2211/35* (2013.01); *F15B 2211/40576* (2013.01)

(56) References Cited

U.S. PATENT DOCUMENTS 8,191,364 B2 * 6/2012 Shimada ..... E02F 9/2285 60/494
8,336,305 B2 * 12/2012 Matsuura ..... F15B 21/14 60/419
9,394,671 B2 * 7/2016 Hirozawa ..... E02F 9/2296
10,914,328 B2 * 2/2021 Ogawa ..... E02F 9/226
2017/0276155 A1 9/2017 Hijikata et al.
2018/0238025 A1 8/2018 Imura et al.
2019/0106861 A1 4/2019 Izumi et al.
2021/0123213 A1 4/2021 Maekawa et al.
2022/0333352 A1 * 10/2022 Kumagai ..... E02F 9/2004
2023/0022248 A1 * 1/2023 Shibata ..... E02F 9/2203

FOREIGN PATENT DOCUMENTS

JP 3594680 B2 12/2004
JP 2014-74433 A 4/2014
JP 2016-75302 A 5/2016
JP 2018-3516 A 1/2018
WO WO 2017/110167 A1 6/2017
WO WO 2019/220872 A1 11/2019
WO WO-2021201158 A1 * 10/2021 ..... E02F 9/2217
WO WO-2021256098 A1 * 12/2021 ..... F15B 11/024

OTHER PUBLICATIONS

Japanese-language Written Opinion (PCT/ISA/237) issued in PCT/JP2021/011253 dated Apr. 20, 2021 (four (4) pages).
International Preliminary Report on Patentability (PCT/IB/338 & PCT/IB/373) issued in PCT Application No. PCT/JP2021/011253 dated Oct. 13, 2022, including English translation of document C2 (Japanese-language Written Opinion (PCT/ISA/237), filed on Mar. 7, 2022 (five (5) pages).

* cited by examiner

WORK MACHINE

TECHNICAL FIELD

The present invention relates to a work machine such as a hydraulic excavator.

BACKGROUND ART

A work machine such as a hydraulic excavator includes a machine body having a swing structure and a work device (front implement) mounted on the swing structure. The work device includes a boom (front member) connected to the swing structure, an arm (front member) connected to a distal end of the boom, a bucket (front member) connected to a distal end of the arm, a boom cylinder (actuator) that drives the boom, an arm cylinder (actuator) that drives the arm, and a bucket cylinder (actuator) that drives the bucket. In such a work machine as described above, when the boom, the arm, or the bucket is moved alone, a distal end of the bucket moves along a trajectory on an arc. Therefore, for example, when the arm is pulled to form a linear finished face at the distal end of the bucket, an operator needs to operate the boom, the arm, and the bucket in a complex way. Thus, the operator is required to have a skilled operation technique.

Thus, there is available a technology in which a function (machine control) for controlling driving of a hydraulic actuator automatically or semiautomatically by a control device (controller) is applied to an excavation work to move the distal end of the bucket along a designed face (target excavation face) during an excavation operation (when the arm or the bucket is operating) (Patent Document 1).

Meanwhile, there are some conventional hydraulic excavators each including a hydraulic fluid regeneration device that can increase an operation speed of a hydraulic actuator by merging a hydraulic fluid of a tank-side flow passage of the hydraulic actuator into a pump-side flow passage thereof (hydraulic fluid regeneration) (Patent Document 2).

In such a circumstance as described above, if the machine control is applied to a hydraulic excavator that includes such a hydraulic fluid regeneration device that can increase an expansion and contraction speed of the arm cylinder, when the hydraulic fluid regeneration is performed by the arm cylinder while the distal end of the bucket is moved along a target excavation face by the machine control, there is a possibility that the operation speed of the arm may fluctuate, causing the distal end of the bucket to dig into the ground more deeply than the target excavation face. In other words, in such a configuration that a return hydraulic fluid of the actuator is merged into the pump-side flow passage, when a target flow rate for the actuator is set according to the machine control (or according to a lever operation of an operator) and control is then executed such that a flow rate of a hydraulic fluid to be supplied from a pump to the actuator coincides with the target flow rate, the flow rate of the hydraulic fluid supplied to the actuator may become higher than the target flow rate, and thus, the position control accuracy of the actuator cannot be secured.

In order to solve such a problem as described above, there is available a technology which secures the position control accuracy of an actuator by machine control in a hydraulic excavator that includes a hydraulic fluid regeneration device that can increase the expansion and contraction speed of a cylinder (Patent Document 3). In the technology, when the hydraulic excavator operates by the machine control, in a condition in which the influence of the hydraulic fluid regeneration is significant, a regeneration flow rate is decreased to restrict the hydraulic fluid regeneration function.

PRIOR ART DOCUMENT

Patent Documents

Patent Document 1: JP-3056254-B
Patent Document 2: JP-3594680-B
Patent Document 3: JP-2018-003516-A

SUMMARY OF THE INVENTION

Problem to be Solved by the Invention

However, when the regeneration function is restricted at the time that the work machine disclosed in Patent Document 3 operates by the machine control, although the position control accuracy of the actuator can be secured, the operation speed of the actuator cannot be increased, possibly resulting in the deteriorated work efficiency. In other words, in such a configuration as to secure the position control accuracy of the actuator by setting a target flow rate for the actuator according to the machine control (or according to a lever operation of an operator) and making a flow rate of a hydraulic fluid to be supplied from the pump to the actuator coincide with the target flow rate, the operation speed of the actuator cannot be increased by merging a return hydraulic fluid of the actuator into the pump-side flow passage.

The present invention has been made in view of the problem described above, and it is an object of the present invention to provide a work machine that can increase an operation speed of an actuator by a regeneration function while securing the position control accuracy of the actuator.

Means for Solving the Problem

In order to achieve the object described above, the present invention provides a work machine that includes a machine body, a work device mounted on the machine body, an actuator that drives the machine body or the work device, a hydraulic working fluid tank, a hydraulic pump that sucks a hydraulic working fluid from the hydraulic working fluid tank and supplies the hydraulic working fluid to the actuator, a flow rate control valve that is connected in parallel to a delivery line of the hydraulic pump and controls a flow of a hydraulic fluid to be supplied from the hydraulic pump to the actuator, an operation lever that gives an instruction for an operation of the actuator, and a controller that controls the flow rate control valve according to an input amount of the operation lever. The work machine includes a regeneration valve that allows a hydraulic working fluid to flow from the meter-out side to the meter-in side of the flow rate control valve, and a selector valve that is provided on a tank line connecting the flow rate control valve and the hydraulic working fluid tank to each other and opens or interrupts the tank line. The controller is configured to calculate a target actuator flow rate that is a target flow rate for the actuator, on the basis of the input amount of the operation lever, calculate a regeneration flow rate that is a flow rate of a hydraulic fluid passing through the regeneration valve, on the basis of the input amount of the operation lever and the target actuator flow rate, subtract the regeneration flow rate from the target actuator flow rate to calculate a target actuator supply flow rate, calculate a target flow rate control valve opening amount on the basis of the target actuator flow rate, calculate a target pump flow rate that is equal to or higher than the total target actuator supply flow rate, control the selector valve on the basis of the input amount of the operation lever, control the flow rate control valve according to the target flow rate control valve opening amount, and control the hydraulic pump according to the target pump flow rate.

According to the present invention configured in such a manner as described above, the flow rate control valve and the hydraulic pump are controlled such that the total of the target flow rate of a hydraulic fluid to be supplied from the hydraulic pump to the actuator (target actuator supply flow rate) and the regeneration flow rate in the actuator becomes equal to the target flow rate for the actuator (target actuator flow rate). Consequently, the operation speed of the actuator can be increased by the regeneration function while the position control accuracy of the actuator is secured.

Advantages of the Invention

With the work machine according to the present invention, the operation speed of the actuator can be increased by the regeneration function while the position control accuracy of the actuator is secured.

MODE FOR CARRYING OUT THE INVENTION

Figure 1:
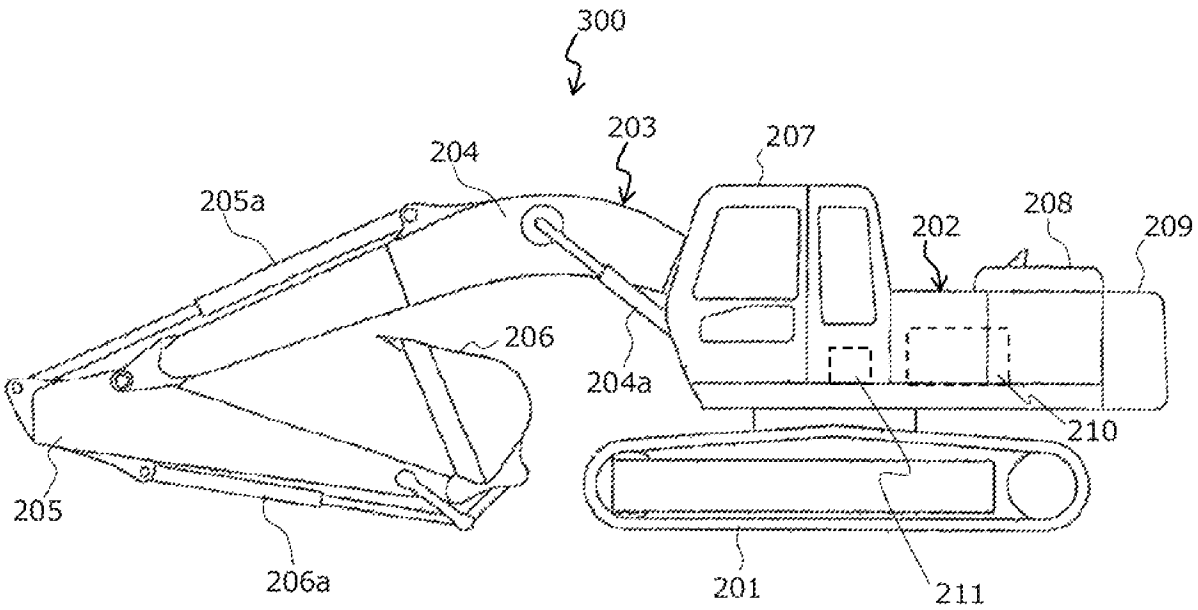
FIG. 1 is a side elevational view of a hydraulic excavator according to an embodiment of the present invention.

In the following, a work machine according to an embodiment of the present invention will be described using a hydraulic excavator as an example with reference to the drawings. It is to be noted that, in the figures, identical members are denoted by the same reference characters, and overlapping description thereof is omitted suitably.

FIG. 1 is a side elevational view of the hydraulic excavator according to the present embodiment.

As depicted in FIG. 1, the hydraulic excavator 300 includes a track structure 201, a swing structure 202 that is rotatably mounted on the track structure 201 and that forms a machine body, and a work device 203 that is mounted pivotably in an upward and downward direction on the swing structure 202 and that performs an excavation work of sediment. The swing structure 202 is driven by a swing motor 211.

The work device 203 includes a boom 204 that is mounted pivotably in the upward and downward direction on the swing structure 202, an arm 205 that is mounted pivotably in the upward and downward direction on a distal end of the boom 204, and a bucket 206 that is mounted pivotably in the upward and downward direction on a distal end of the arm 205. The boom 204 is driven by a boom cylinder 204*a*, the arm 205 is driven by an arm cylinder 205*a*, and the bucket 206 is driven by a bucket cylinder 206*a*.

An operation room 207 is disposed on a front side of the swing structure 202, and a counterweight 209 for securing the weight balance is disposed on a rear side of the swing structure 202. A machine room 208 in which an engine, a hydraulic pump, and so forth are accommodated is disposed between the operation room 207 and the counterweight 209, and a control valve 210 is installed in the machine room 208. The control valve 210 controls the flow of a hydraulic working fluid from the hydraulic pump to the respective actuators.

A hydraulic drive system that is described below in working examples is incorporated in the hydraulic excavator 300 according to the present embodiment.

First Working Example

Figure 2A:
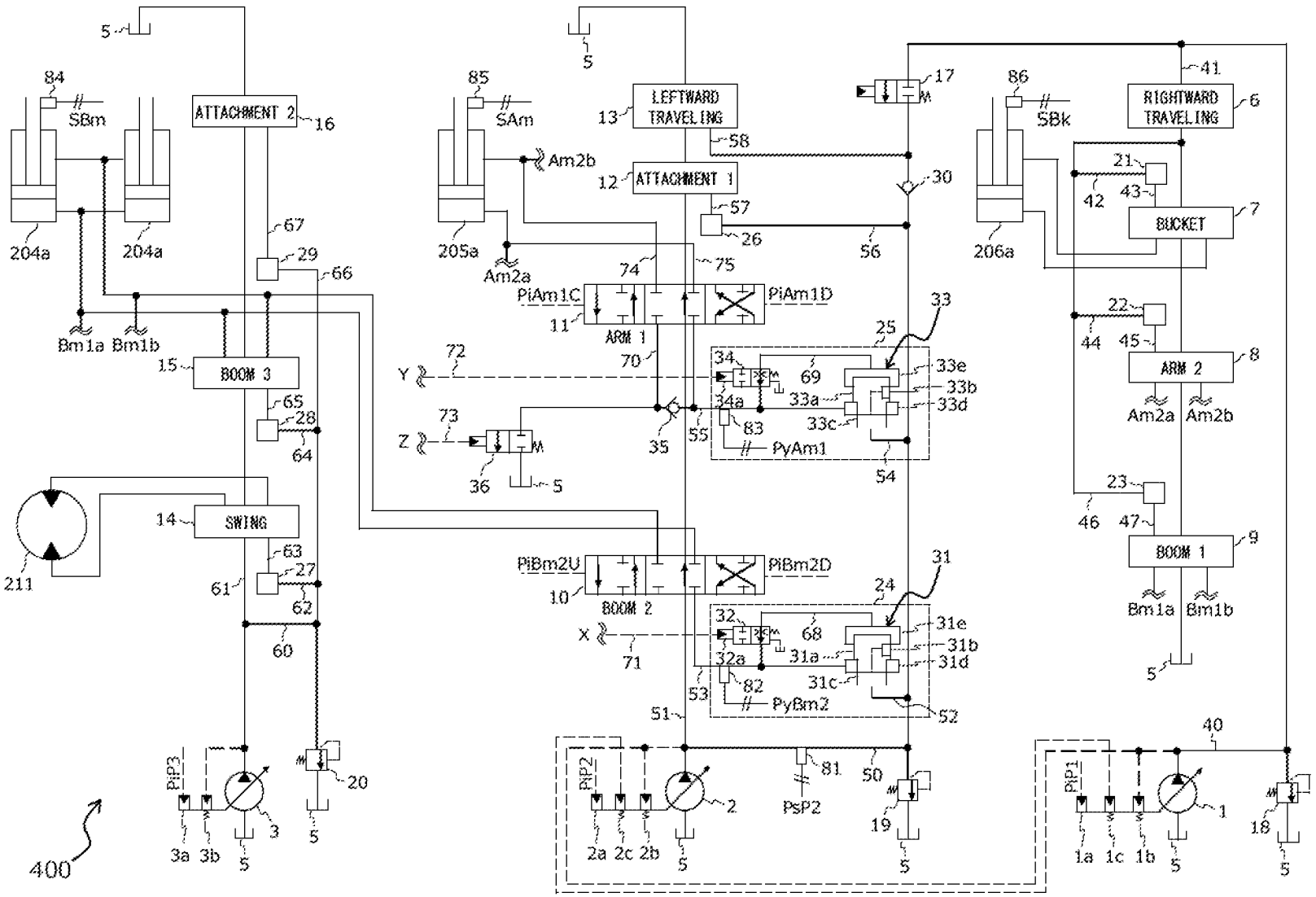
FIG. 2A is a circuit diagram (1/2) of a hydraulic drive system according to a first working example of the present invention.
Figure 2B:
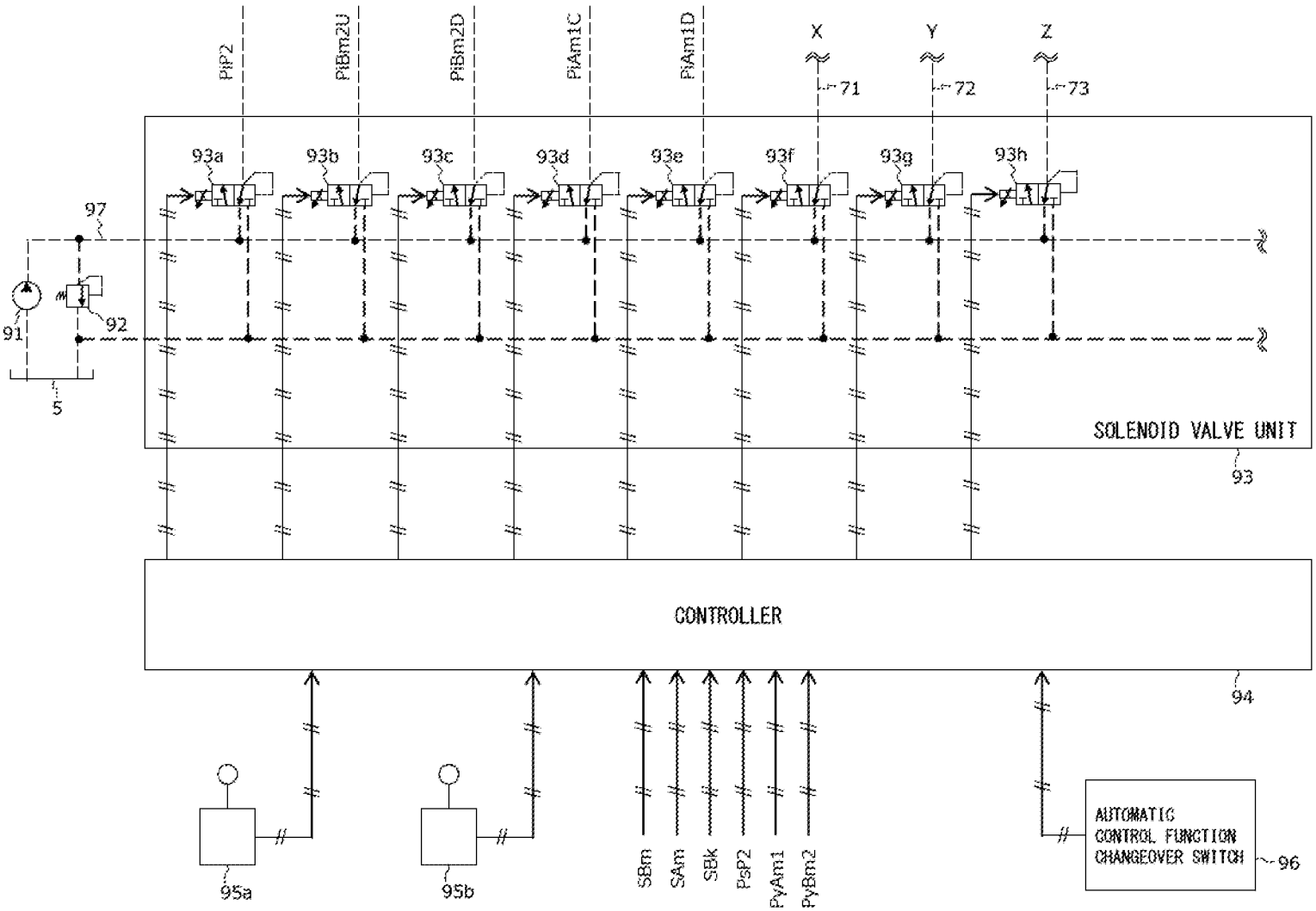
FIG. 2B is a circuit diagram (2/2) of the hydraulic drive system according to the first working example of the present invention.

FIGS. 2A and 2B are circuit diagrams of a hydraulic drive system according to a first working example of the present invention.

(1) Configuration

A hydraulic drive system 400 according to the first working example includes three main hydraulic pumps driven by an engine (not depicted). The three main hydraulic pumps are, for example, a first hydraulic pump 1, a second hydraulic pump 2, and a third hydraulic pump 3 that are each include a variable displacement hydraulic pump. The hydraulic drive system 400 also includes a pilot pump 91 driven by the engine and hydraulic working fluid tanks 5 that supply hydraulic fluids to the hydraulic pumps 1 to 3 and the pilot pump 91.

A tilting angle of the first hydraulic pump 1 is controlled by a regulator attached to the first hydraulic pump 1. The regulator of the first hydraulic pump 1 includes a flow rate control command pressure port 1*a*, a first hydraulic pump self-pressure port 1*b*, and a second hydraulic pump self-pressure port 1*c*. A tilting angle of the second hydraulic pump 2 is controlled by a regulator attached to the second hydraulic pump 2. The regulator of the second hydraulic pump 2 includes a flow rate control command pressure port 2*a*, a second hydraulic pump self-pressure port 2*b*, and a first hydraulic pump self-pressure port 2*c*. A tilting angle of the third hydraulic pump 3 is controlled by a regulator attached to the third hydraulic pump 3. The regulator of the third hydraulic pump 3 includes a flow rate control command pressure port 3*a* and a third hydraulic pump self-pressure port 3*b*.

A delivery line 40 of the first hydraulic pump 1 is connected to the hydraulic working fluid tank 5 through a center bypass line 41. On the center bypass line 41, a rightward traveling directional control valve 6, a bucket directional control valve 7, a second arm directional control valve 8, and a first boom directional control valve 9 are arranged in order from the upstream side. The rightward traveling directional control valve 6 controls driving of a rightward traveling motor, which is not depicted, of a pair of traveling motors for driving the track structure 201. The bucket directional control valve 7 controls the flow of a hydraulic fluid to be supplied to the bucket cylinder 206*a*. The second arm directional control valve 8 controls the flow of a hydraulic fluid to be supplied to the arm cylinder 205*a*. The first boom directional control valve 9 controls the flow of a hydraulic fluid to be supplied to the boom cylinder 204*a*. The bucket directional control valve 7, the second arm directional control valve 8, and the first boom directional control valve 9 are connected at meter-in ports thereof in parallel to part of the center bypass line 41 which connects the rightward traveling directional control valve 6 and the bucket directional control valve 7 to each other, through hydraulic lines 42 and 43, hydraulic lines 44 and 45, and hydraulic lines 46 and 47, respectively. Further, the delivery line 40 is connected to the hydraulic working fluid tank 5 via a main relief valve 18 in order to protect the circuit from an excessive pressure rise. On the delivery line 40, a pressure sensor (not depicted) for detecting the pressure of the first hydraulic pump 1 is provided.

A delivery line 50 of the second hydraulic pump 2 is connected to the hydraulic working fluid tank 5 through a center bypass line 51. On the center bypass line 51, a second boom directional control valve 10, a first arm directional control valve 11, a first attachment directional control valve 12, and a leftward traveling directional control valve 13 are arranged in order from the upstream side. The second boom directional control valve 10 controls the flow of a hydraulic fluid to be supplied to the boom cylinder 204*a*. The first arm directional control valve 11 controls the flow of a hydraulic fluid to be supplied to the arm cylinder 205*a*. The first attachment directional control valve 12 controls the flow of a hydraulic fluid to be supplied to a first actuator, which is not depicted, for driving a first special attachment such as a crusher that is provided in place of the bucket 206. The leftward traveling directional control valve 13 controls driving of a leftward traveling motor, which is not depicted, of the pair of traveling motors for driving the track structure 201. The second boom directional control valve 10, the first arm directional control valve 11, the first attachment directional control valve 12, and the leftward traveling directional control valve 13 are connected at meter-in ports thereof in parallel to the delivery line 50 of the second hydraulic pump 2 through hydraulic lines 52 and 53, hydraulic lines 54 and 55, hydraulic lines 56 and 57, and a hydraulic line 58, respectively. The hydraulic line 58 is connected to the delivery line 40 of the first hydraulic pump 1 via a merge valve 17. A check valve 30 is provided between the hydraulic line 58 and the delivery line 50 of the second hydraulic pump 2. The check valve 30 prevents a hydraulic fluid which is to be supplied from the first hydraulic pump 1 to the delivery line 50 via the merge valve 17, from flowing into the directional control valves 10 to 12 arranged on the upstream side of the leftward traveling directional control valve 13. Further, the delivery line 50 is connected to the hydraulic working fluid tank 5 via a main relief valve 19 in order to protect the circuit from an excessive pressure rise. A pressure sensor 81 for detecting the pressure of the second hydraulic pump 2 is provided on the delivery line 50.

The first arm directional control valve 11 is connected at a meter-out port thereof to the hydraulic working fluid tank 5 through a tank line 70. A selector valve 36 is arranged on the tank line 70. The selector valve 36 is connected on the upstream side thereof to a hydraulic line 55 via a regeneration valve 35. The regeneration valve 35 allows a hydraulic fluid to flow from the tank line 70 (meter-out port of the directional control valve 11) to the hydraulic line 55 (meter-in port of the directional control valve 11) but prevents the hydraulic fluid from flowing in the reverse direction.

A delivery line 60 of the third hydraulic pump 3 is connected to the hydraulic working fluid tank 5 through a center bypass line 61. On the center bypass line 61, a swinging directional control valve 14, a third boom directional control valve 15, and a second attachment directional control valve 16 are arranged in order from the upstream side. The swinging directional control valve 14 controls the flow of a hydraulic fluid to be supplied to the swing motor 211. The third boom directional control valve 15 controls the flow of a hydraulic fluid to be supplied to the boom cylinder 204*a*. The second attachment directional control valve 16 is used to control, when a second special attachment including a second actuator is mounted in addition to the first special attachment or when a second special attachment including two actuators, that is, the first actuator and the second actuator, is mounted in place of the first special actuator, the flow of a hydraulic fluid to be supplied to the second actuator. The swinging directional control valve 14, the third boom directional control valve 15, and the second attachment directional control valve 16 are connected at meter-in ports thereof in parallel to the delivery line 60 of the third hydraulic pump 3 through hydraulic lines 62 and 63, hydraulic lines 64 and 65, and hydraulic lines 67 and 67, respectively. Further, the delivery line 60 is connected to the hydraulic working fluid tank 5 via a main relief valve 20 in order to protect the circuit from an excessive pressure rise. A pressure sensor (not depicted) for detecting the pressure of the third hydraulic pump 3 is provided on the delivery line 60.

Stroke sensors 84, 85, and 86 for detecting a stroke amount are provided for the boom cylinder 204*a*, the arm cylinder 205*a*, and the bucket cylinder 206*a*, respectively, in order to acquire an operation state of the hydraulic excavator 300. It is to be noted that various elements such as a tilt sensor, a rotation angle sensor, and an IMU can be used as means for acquiring an operation state of the hydraulic excavator 300, and the means mentioned is not limited to the stroke sensors described above.

An auxiliary flow rate control valve 21 is provided on the hydraulic lines 42 and 43 connected to the bucket directional control valve 7, an auxiliary flow rate control valve 22 is provided on the hydraulic lines 44 and 45 connected to the second arm directional control valve 8, and an auxiliary flow rate control valve 23 is provided on the hydraulic lines 46 and 47 connected to the first boom directional control valve 9. The auxiliary flow rate control valves 21, 22, and 23 restrict the flow rate of a hydraulic fluid to be supplied from the first hydraulic pump 1 to the directional control valves 7 to 8 upon a combined operation. An auxiliary flow rate control valve 24 is provided on the hydraulic lines 52 and 53 connected to the meter-in port of the second boom directional control valve 10, an auxiliary flow rate control valve 25 is provided on the hydraulic lines 54 and 55 connected to the meter-in port of the first arm directional control valve 11, and an auxiliary flow rate control valve 26 is provided on the hydraulic lines 56 and 57 connected to the meter-in port of the first attachment directional control valve 12. The auxiliary flow rate control valves 24, 25, and 26 restrict the flow rate of a hydraulic fluid to be supplied from the second hydraulic pump 2 to the directional control valves 10 to 12 upon a combined operation. An auxiliary flow rate control valve 27 is provided on the hydraulic lines 62 and 63 connected to the meter-in port of the swinging directional control valve 14, an auxiliary flow rate control valve 28 is provided on the hydraulic lines 64 and 65 connected to the meter-in port of the third boom directional control valve 15, and an auxiliary flow rate control valve 29 is provided on the hydraulic lines 66 and 67 connected to the meter-in port of the second attachment directional control valve 16. The auxiliary flow rate control valves 27, 28, and 29 restrict the flow rate of a hydraulic fluid to be supplied from the third hydraulic pump 3 to the directional control valves 14 to 16 upon a combined operation.

A delivery port of the pilot pump 91 is connected to the hydraulic working fluid tank 5 via a pilot relief valve 92 used for generating pilot primary pressure and is also connected to one input port of each of solenoid proportional valves 93*a* to 93*h* built in a solenoid valve unit 93, through a hydraulic line 97. The other input port of each of the solenoid proportional valves 93*a* to 93*h* is connected to the hydraulic working fluid tank 5. Each of the solenoid proportional valves 93*a* to 93*h* decompresses the pilot primary pressure according to a command signal from a controller 94 to generate pilot command pressure.

An output port of the solenoid proportional valve 93*a* is connected to the flow rate control command pressure port 2*a* of the regulator for the second hydraulic pump 2. Output ports of the solenoid proportional valves 93*b* and 93*c* are connected to pilot ports of the second boom directional control valve 10. Output ports of the solenoid proportional valves 93*d* and 93*e* are connected to pilot ports of the first arm directional control valve 11. An output port of the solenoid proportional valve 93*f* is connected to a pilot port of the auxiliary flow rate control valve 24 (pilot port 32*a* of pilot variable restrictor 32) through a hydraulic line 71. An output port of the solenoid proportional valve 93*g* is connected to a pilot port of the auxiliary flow rate control valve 25 (pilot port 34*a* of pilot variable restrictor 34) through a hydraulic line 72. An output port of the solenoid proportional valve 93*h* is connected to a pilot port of the selector valve 36 through a hydraulic line 73.

It is to be noted that, in order to simplify the description, the following solenoid proportional valves are not illustrated in the figures: solenoid proportional valves for the flow rate control command pressure ports 1*a* and 3*a* of the regulators for the first hydraulic pump 1 and the third hydraulic pump 3, a solenoid proportional valve for the rightward traveling directional control valve 6, a solenoid proportional valve for the bucket directional control valve 7, a solenoid proportional valve for the second arm directional control valve 8, a solenoid proportional valve for the first boom directional control valve 9, a solenoid proportional valve for the first attachment directional control valve 12, a solenoid proportional valve for the leftward traveling directional control valve 13, a solenoid proportional valve for the swinging directional control valve 14, a solenoid proportional valve for the third boom directional control valve 15, a solenoid proportional valve for the second attachment directional control valve 16, and solenoid proportional valves for the auxiliary flow rate control valves 21 to 23 and 26 to 29.

The auxiliary flow rate control valve 24 includes a main valve 31 in the form of a sheet that forms an auxiliary variable restrictor, a control variable restrictor 31*b* that is provided on a valve body 31*a* of the main valve 31 and that changes the opening amount according to the amount of movement of the valve body 31*a*, and the pilot variable restrictor 32. A housing in which the main valve 31 is built has a first pressure chamber 31*c* formed at a connection portion between the main valve 31 and a hydraulic line 52, a second pressure chamber 31*d* formed at a connection portion between the main valve 31 and the hydraulic line 53, and a third pressure chamber 31*e* formed so as to communicate with the first pressure chamber 31*c* via the control variable restrictor 31*b*. The pilot variable restrictor 32 is arranged on a hydraulic line 68 that connects the third pressure chamber 31*e* and the hydraulic line 53 to each other. The pilot port 32*a* of the pilot variable restrictor 32 is connected to the output port of the solenoid proportional valve 93*f*. A pressure sensor 82 is provided on the hydraulic line 53 that connects the second boom directional control valve 10 and the auxiliary flow rate control valve 24 (main valve 31) to each other. It is to be noted that, although illustration is omitted partly in order to simplify the description, the auxiliary flow rate control valves 21 to 29 and their associated components, pipes, and wirings are all configured similarly.

The hydraulic drive system 400 includes a boom operation lever 95*a* that can switch between the first boom directional control valve 9, the second boom directional control valve 10, and the third boom directional control valve 15, and an arm operation lever 95*b* that can switch between the first arm directional control valve 11 and the second arm directional control valve 8. It is to be noted that, in order to simplify the description, the following operation levers are not illustrated in the figures: a rightward traveling operation lever for switching to and operating the rightward traveling directional control valve 6, a bucket operation lever for switching to and operating the bucket directional control valve 7, a first attachment operation lever for switching to and operating the first attachment directional control valve 12, a leftward traveling operation lever for switching to and operating the leftward traveling directional control valve 13, a swinging operation lever for switching to and operating the swinging directional control valve 14, and a second attachment operation lever for switching to and operating the second attachment directional control valve 16.

The hydraulic drive system 400 includes the controller 94. The controller 94 receives, as input, input amounts of the operation levers 95*a* and 95*b*, output values of the pressure sensors 81 to 83, and output values of the stroke sensors 84 to 86. Further, the controller 94 outputs command signals to the solenoid proportional valves 93*a* to 93*h* (including the solenoid proportional valves not depicted) of the solenoid valve unit 93.

Figure 3:
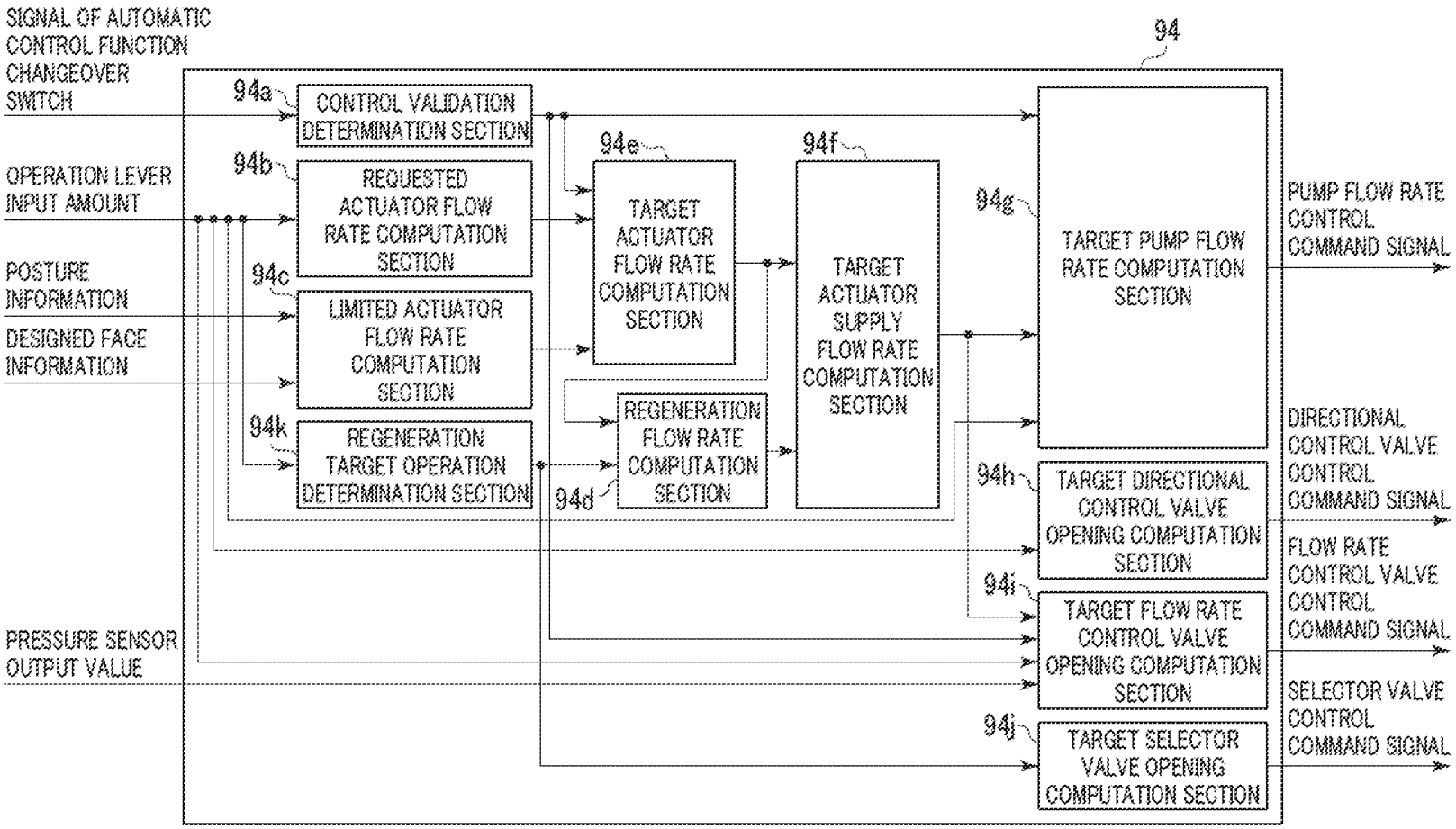
FIG. 3 is a functional block diagram of a controller in the first working example of the present invention.

FIG. 3 is a functional block diagram of the controller 94. Referring to FIG. 3, the controller 94 includes a control validation determination section 94*a*, a requested actuator flow rate computation section 94*b*, a limited actuator flow rate computation section 94*c*, a regeneration target operation determination section 94*k*, a target actuator flow rate computation section 94*e*, a regeneration flow rate computation section 94*d*, a target actuator supply flow rate computation section 94*f*, a target pump flow rate computation section 94*g*, a target directional control valve opening computation section 94*h*, a target flow rate control valve opening computation section 94*i*, and a target selector valve opening computation section 94*j*.

The control validation determination section 94*a* determines, on the basis of a signal from an automatic control function changeover switch 96, whether or not an automatic control function is valid. The requested actuator flow rate computation section 94*b* calculates a demanded flow rate for the actuators on the basis of an operation lever input amount. On the basis of posture information of the machine body 202 or the work device 203 obtained from signals of the stroke sensors 84 to 86 and so forth and designed face information set in advance (including a registered target trajectory of the actuators and so forth), the limited actuator flow rate computation section 94*c* calculates, as a limited flow rate, an actuator flow rate for controlling the machine body 202 or the work device 203 such that the machine body 202 or the work device 203 does not deviate from a set restricted area. The regeneration target operation determination section 94*k* determines, on the basis of input amounts of the operation levers 95*a* and 95*b*, whether or not the operation of an actuator is the operation to which the regeneration function can be applied (regeneration target operation).

The target actuator flow rate computation section 94*e* calculates a target flow rate of a hydraulic fluid to be supplied to the actuators (target actuator flow rate), on the basis of a result of the determination from the control validation determination section 94*a*, a demanded flow rate for the actuator from the requested actuator flow rate computation section 94*b*, and a limited flow rate for the actuator from the limited actuator flow rate computation section 94*c*. The regeneration flow rate computation section 94*d* calculates a flow rate of a hydraulic fluid passing through the regeneration valve 35 (regeneration flow rate), on the basis of a target actuator flow rate from the target actuator flow rate computation section 94*e* and a result of the determination from the regeneration target operation determination section 94*k*. The target actuator supply flow rate computation section 94*f* calculates a target flow rate of a hydraulic fluid to be supplied from the hydraulic pump to the actuator (target actuator supply flow rate), on the basis of a target actuator flow rate from the target actuator flow rate computation section 94*e* and a regeneration flow rate from the regeneration flow rate computation section 94*d*.

The target pump flow rate computation section 94*g* calculates a target flow rate for the hydraulic pumps 1 to 3 (target pump flow rate) on the basis of a result of the determination from the control validation determination section 94*a*, a target actuator supply flow rate from the target actuator supply flow rate computation section 94*f*, and an operation lever input amount, and outputs a command signal (pump flow rate control command signal) according to the target pump flow rate. The target directional control valve opening computation section 94*h* calculates a target opening amount for the directional control valves 6 to 16 on the basis of an input amount of the operation levers 95*a* and 95*b*, and outputs a command signal (directional control valve control command signal) according to the target opening amount. The target flow rate control valve opening computation section 94*i* calculates a target opening amount for the auxiliary flow rate control valves 21 to 29 on the basis of a result of the determination from the control validation determination section 94*a*, a target actuator supply flow rate from the target actuator supply flow rate computation section 94*f*, an operation lever input amount, and a pressure sensor output value, and outputs a command signal (flow rate control valve control command signal) according to the target opening amount. The target selector valve opening computation section 94*j* calculates a target opening amount for the selector valve 36 on the basis of a result of the determination from the regeneration target operation determination section 94*k*, and outputs a command signal (selector valve control command signal) according to the target opening amount.

Figure 4:
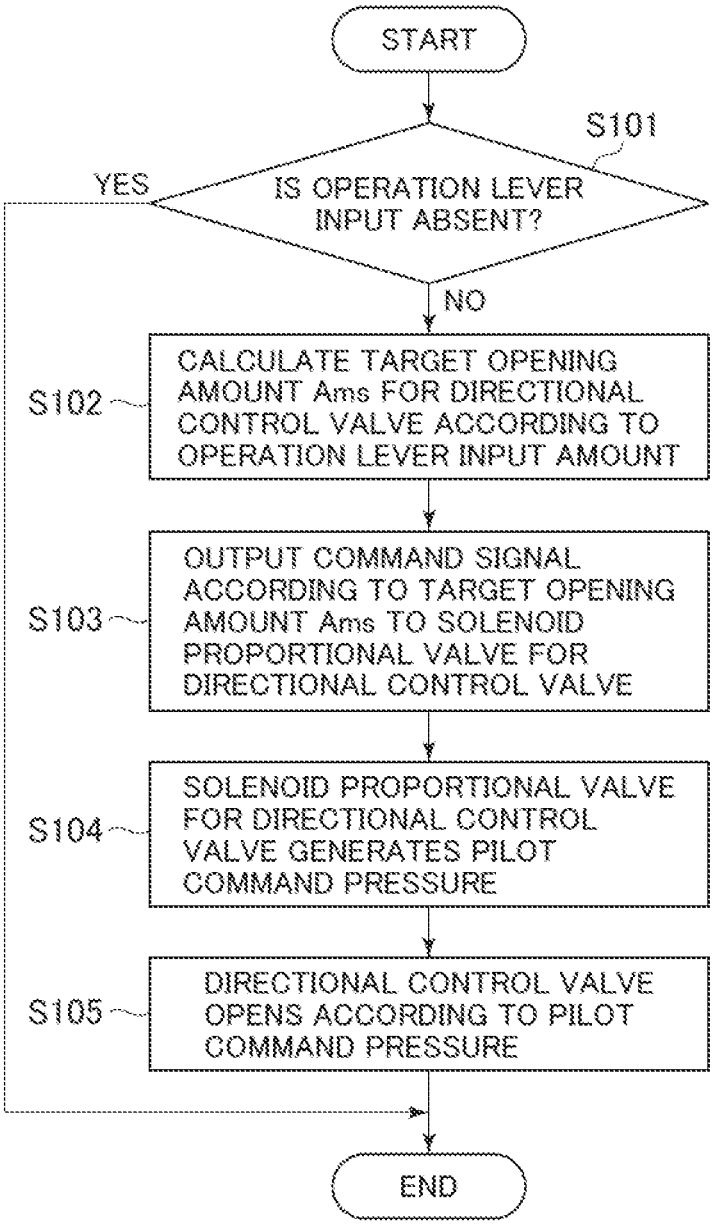
FIG. 4 is a flow chart depicting processing relating to control of a directional control valve by the controller in the first working example of the present invention.

FIG. 4 is a flow chart depicting processing relating to control of the directional control valves 6 to 16 by the controller 94. In the following, only processing relating to the first arm directional control valve 11 is described. Since processing relating to the other directional control valves is similar to the processing relating to the first arm directional control valve 11, redundant description is omitted.

The controller 94 first determines whether or not an input of the arm operation lever 95*b* is absent (step S101). When it is determined in step S101 that an input of the arm operation lever 95*b* is absent (YES), the controller 94 ends the processing. When it is determined in step S101 that an input of the arm operation lever 95*b* is present (NO), the target directional control valve opening computation section 94*h* of the controller 94 calculates a target opening amount Ams for the directional control valve 11 according to the input amount of the arm operation lever 95*b* (step S102).

After step S102, the controller 94 outputs a command signal according to the target opening amount Ams to the solenoid proportional valves 93*d* and 93*e* for the directional control valve 10 (S103), causes the solenoid proportional valves 93*d* and 93*e* to generate pilot command pressure for the directional control valve 11 (S104), and causes the directional control valve 10 to open according to the pilot command pressure (S105). Then, the controller 94 ends the processing.

Figure 5:
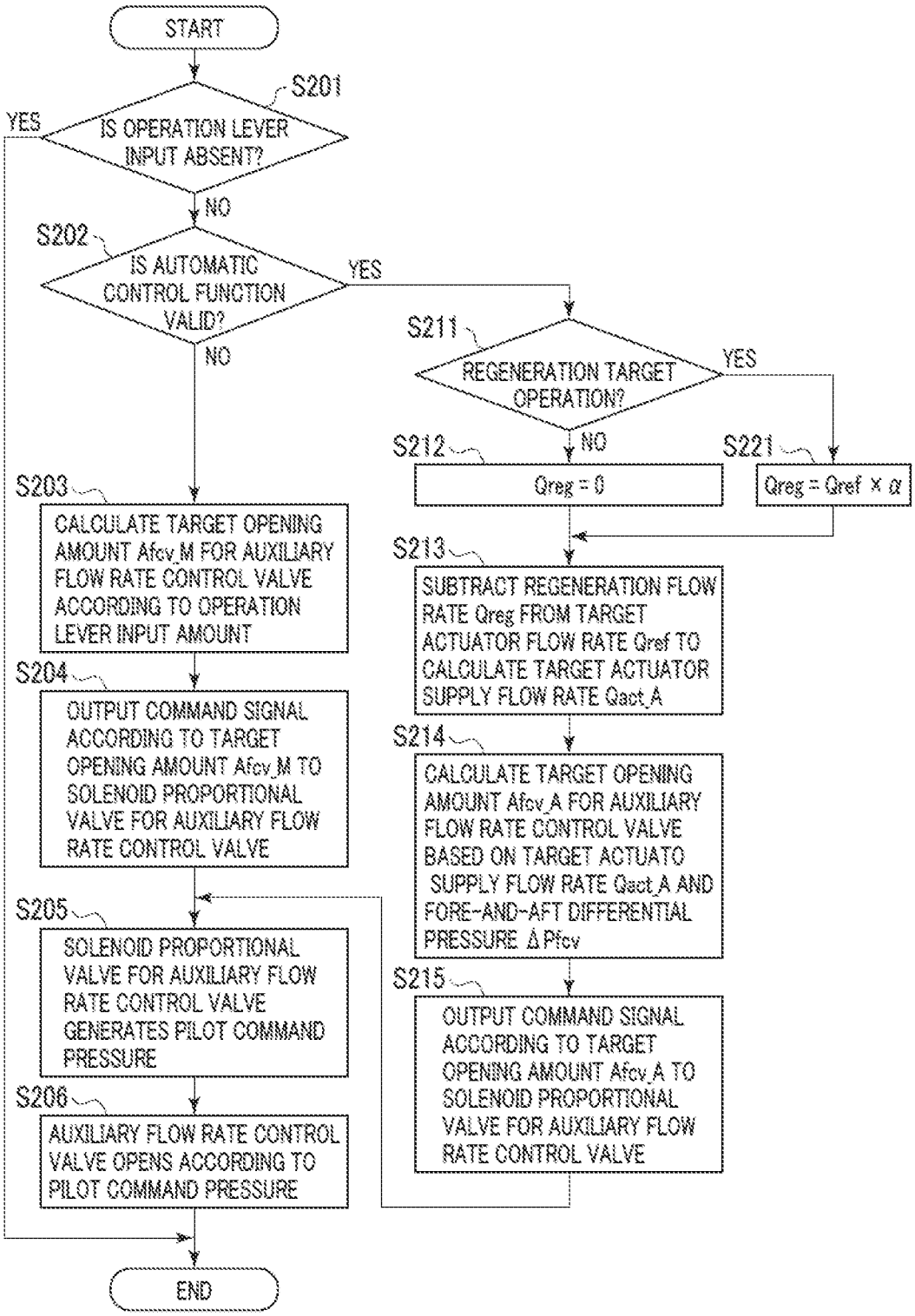
FIG. 5 is a flow chart depicting processing relating to control of an auxiliary flow rate control valve by the controller in the first working example of the present invention.

FIG. 5 is a flow chart depicting processing relating to control of the auxiliary flow rate control valves 21 to 29 by the controller 94. In the following, only processing relating to control of the auxiliary flow rate control valve 25 corresponding to the first arm directional control valve 11 is described. Since processing relating to control of the other auxiliary flow rate control valves is similar to the processing relating to the control of the auxiliary flow rate control valve 25, redundant description is omitted.

The controller 94 first determines whether or not an input of the arm operation lever 95*b* is absent (step S201). When it is determined in step S201 that an input of the arm operation lever 95*b* is absent (YES), the controller 94 ends the processing. When it is determined in step S201 that an input of the arm operation lever 95*b* is present (NO), the controller 94 determines whether or not the automatic control function (machine control) is valid (step S202).

When it is determined in step S202 that the automatic control function is invalid (NO), the target flow rate control valve opening computation section 94*i* of the controller 94 calculates a target opening amount Afcv_M for the auxiliary flow rate control valve 25 (main valve 33) according to the input amount of the arm operation lever 95*b* (step S203), outputs a command signal according to the target opening amount Afcv_M to the solenoid proportional valve 93*g* for the auxiliary flow rate control valve 25 (S204), causes the solenoid proportional valve 93*g* to generate pilot command pressure for the auxiliary flow rate control valve 25 (main valve 33) (S205), and causes the auxiliary flow rate control valve 25 (main valve 33) to open according to the pilot command pressure (S206). Then, the controller 94 ends the processing.

When it is determined in step S202 that the automatic control function is valid (YES), the regeneration target operation determination section 94*k* of the controller 94 determines, on the basis of the input amount of the arm operation lever 95*b*, whether or not the operation of the arm cylinder 205*a* is the regeneration target operation (step S211). In the present working example, when the arm operation lever 95*b* is operated in the arm crowding direction, the regeneration target operation determination section 94*k* determines that the operation of the arm cylinder 205*a* is the reproduction target operation (YES), but when the arm operation lever 95*b* is operated in the arm dumping direction, the regeneration target operation determination section 94*k* determines that the operation of the arm cylinder 205*a* is not the reproduction target operation (NO).

When it is determined in step S211 that the operation of the arm cylinder 205*a* is not the reproduction object operation (NO), the regeneration flow rate computation section 94*d* of the controller 94 sets a regeneration flow rate Qreg to zero (step S212), but when it is determined that the operation of the arm cylinder 205*a* is the reproduction object operation (YES), the regeneration flow rate computation section 94*d* multiplies the regeneration flow rate Qreg by a meter-in meter-out flow rate α to calculate the regeneration flow rate Qreg (step S221). Here, the meter-in meter-out flow rate α is a ratio of a meter-out flow rate Qact_MO to a meter-in flow rate Qact_MI and is defined by the following expression.

(Expression 1)

$$\alpha = Qact_MO / Qact_MI \quad (1)$$

It is to be noted that the meter-in meter-out flow rate α need not necessarily be calculated on the basis of the flow rate but may be calculated, for example, on the basis of a pressure receiving areas on the bottom side and the rod side of the hydraulic cylinder piston.

After step S212 or step S221, the target actuator supply flow rate computation section 94*f* of the controller 94 subtracts the regeneration flow rate Qreg from a target actuator flow rate Qref to calculate a target actuator supply flow rate Qact_A (step S213), and the target flow rate control valve opening computation section 94*i* of the controller 94 calculates a target opening amount Afcv_A for the auxiliary flow rate control valve 24 on the basis of the target actuator supply flow rate Qact_A and a fore-and-aft differential pressure ΔPfcv across the auxiliary flow rate control valve 24 (main valve 31) (step S214), and outputs a command signal according to the target opening amount Afcv_A to the solenoid proportional valve 93*f* for the auxiliary flow rate control valve 24 (step S215). Then, after the controller 94 executes the processing in steps S205 and S206, it ends the processing.

Figure 6:
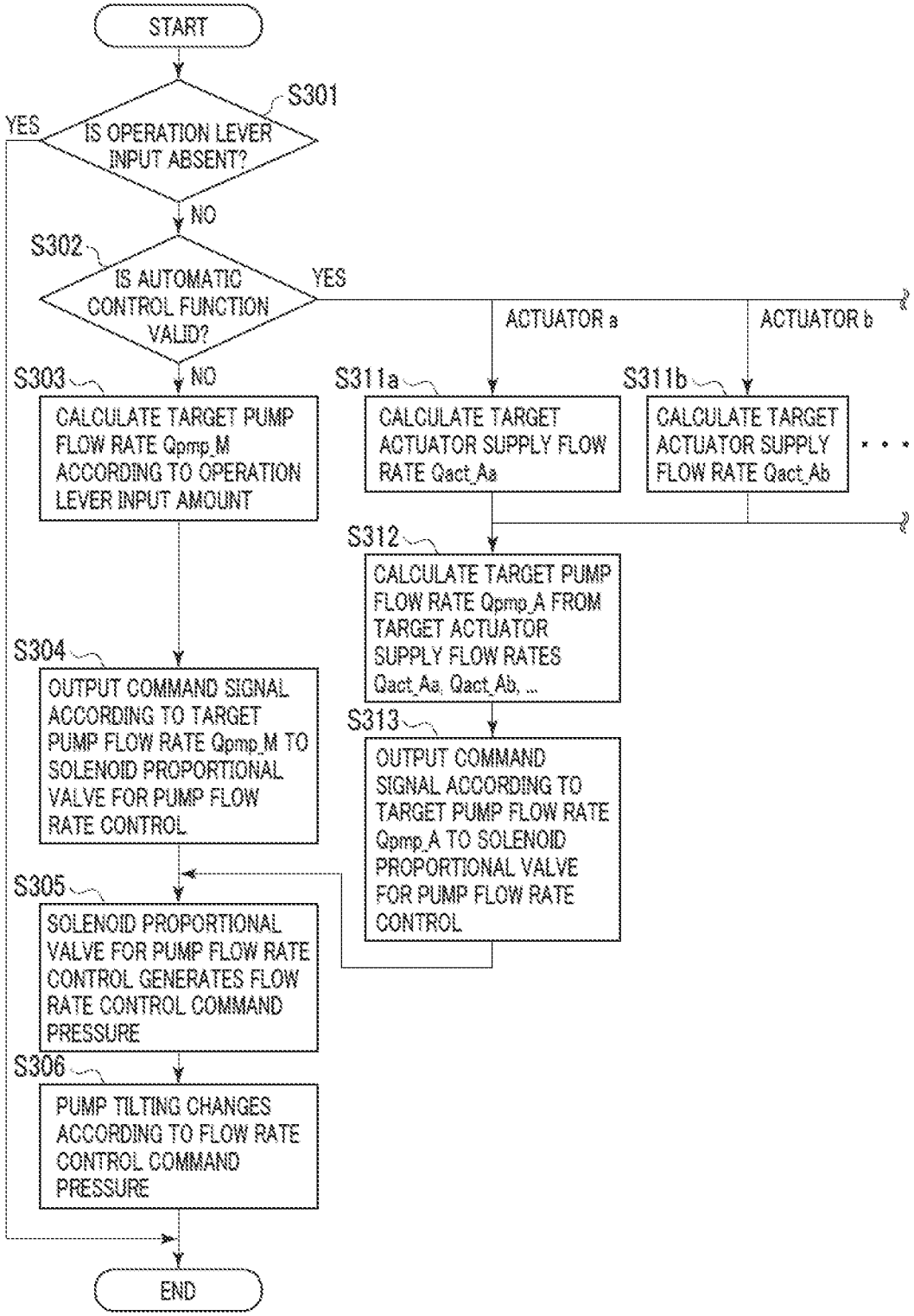
FIG. 6 is a flow chart depicting processing relating to control of a hydraulic pump by the controller in the first working example of the present invention.

FIG. 6 is a flow chart depicting processing relating to control of the hydraulic pumps 1 to 3 by the controller 94. In the following, only processing relating to control of the second hydraulic pump 2 is described. Since processing relating to control of the other hydraulic pumps is similar to the processing relating to the control of the second hydraulic pump 2, redundant description is omitted.

The controller 94 first determines whether or not an input of the operation levers 95*a* and 95*b* is absent (step S301). When the controller 94 determines in step S301 that an input of the operation levers 95*a* and 95*b* is absent (YES), it ends the processing. When it is determined in step S301 that an input of the operation levers 95*a* and 95*b* is present (NO), the controller 94 determines whether or not the automatic control function is valid (step S302).

When it is determined in step S302 that the automatic control function is invalid (NO), the target pump flow rate computation section 94*g* of the controller 94 calculates a target pump flow rate Qpmp_M for the second hydraulic pump 2 according to the input amount of the operation levers 95*a* and 95*b* (step S303), outputs a command signal according to the target pump flow rate Qpmp_M to the solenoid proportional valve 93*a* for the flow rate control of the second hydraulic pump 2 (S304), causes the solenoid proportional valve 93*a* to generate flow rate control command pressure PiP2 for the hydraulic pump 2 (S305), and changes the tilting of the second hydraulic pump 2 according to the flow rate control command pressure PiP2 (S306). Then, the controller 94 ends the processing.

When it is determined in step S302 that the automatic control function is valid (YES), the target actuator supply flow rate computation section 94*f* of the controller 94 calculates target actuator supply flow rates Qact_Aa, Qact_Ab, . . . (steps S311*a*, S311*b*, . . . ). Here, the target actuator supply flow rate Qact_Aa is a target flow rate of a hydraulic fluid to be supplied from the second hydraulic pump 2 to the boom cylinder 204*a*, and the target actuator supply flow rate Qact_Ab is a target flow rate of a hydraulic fluid to be supplied from the second hydraulic pump 2 to the arm cylinder 205*a*.

After steps S311*a*, S311*b*, . . . , the target pump flow rate computation section 94*g* of the controller 94 calculates, as a target pump flow rate Qpmp_A, the total of the target flow rates Qact_Aa, Qact_Ab, . . . for the respective actuators (step S312), and outputs a command signal according to the target pump flow rate Qpmp_A to the solenoid proportional valve 93*a* for the flow rate control of the hydraulic pump 2 (S313). Then, the controller 94 executes the processing in steps S305 and S306 and ends the processing. Here, the target pump flow rate Qpmp_A is set suitably by a designer and need not be made coincide strictly with the total of the target flow rates for the respective actuators, and a bleed-off flow rate and/or a drain flow rate may be added to the target pump flow rate Qpmp_A.

Figure 7:
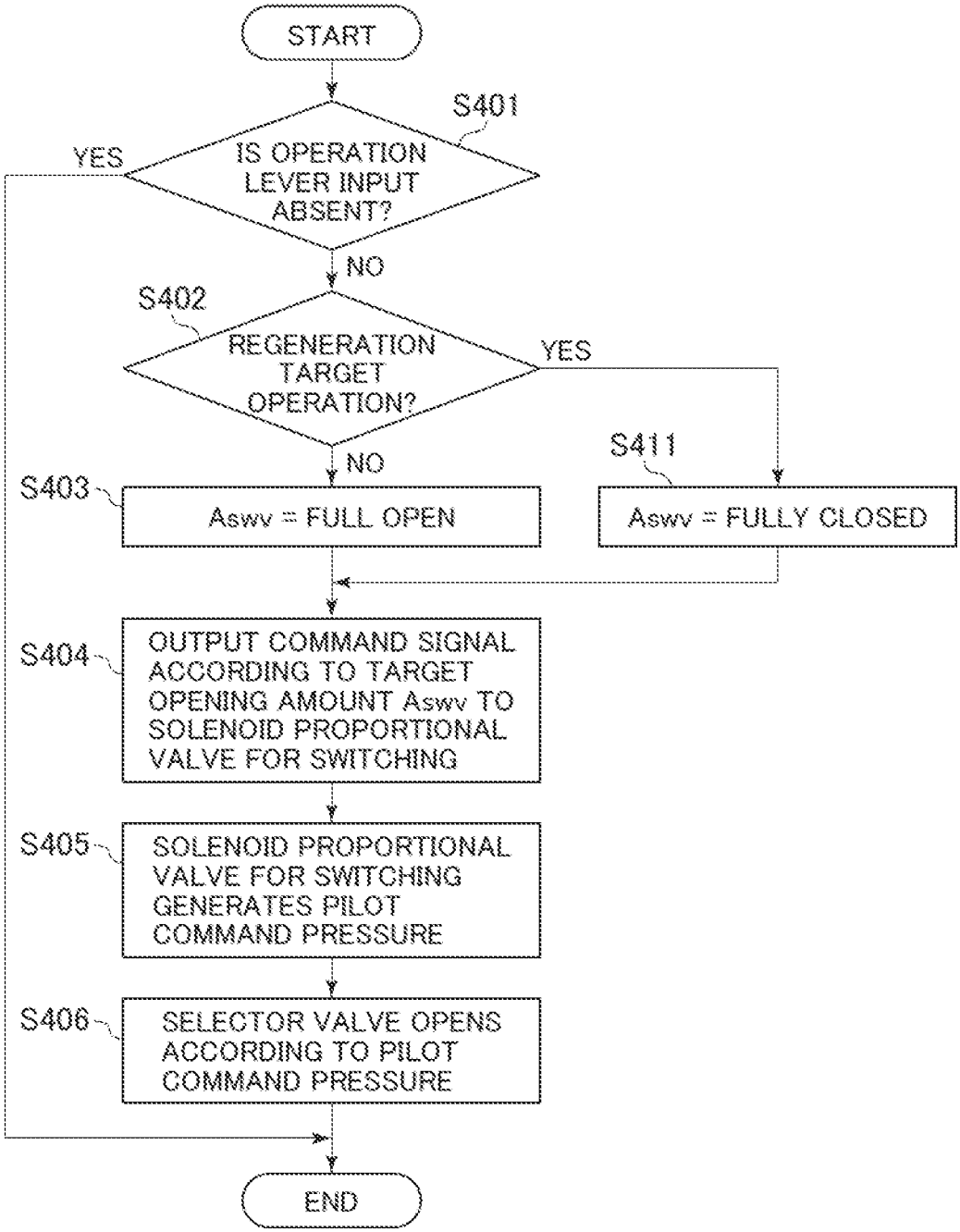
FIG. 7 is a flow chart depicting processing relating to control of a selector valve by the controller in the first working example of the present invention.

FIG. 7 is a flow chart depicting processing relating to control of the selector valve 36 by the controller 94. In the following, only processing relating to control of the selector valve 36 corresponding to the first arm directional control valve 11 is described. Since processing relating to control of the other selector valves (not depicted) is similar to the processing relating to the control of the selector valve 36, redundant description is omitted.

The controller 94 first determines whether or not an input of the arm operation lever 95*b* is absent (step S401). When it is determined in step S401 that an input of the arm operation lever 95*b* is absent (YES), it ends the processing. When it is determined in step S401 that an input of the arm operation lever 95*b* is present (NO), the controller 94 determines whether or not the operation is the regeneration target operation (step S402). In the present working example, when the arm operation lever 95*b* is operated in the arm crowding direction, the controller 94 determines that the operation is the regeneration target operation (YES), but when the arm operation lever 95*b* is operated in the arm dumping direction, the controller 94 determines that the operation is not the regeneration target operation (NO).

When the controller 94 determines in step S402 that the operation is the regeneration target operation (NO), the target selector valve opening computation section 94*j* of the controller 94 sets a target opening amount Avtv_M for the selector valve 36 to full open (step S403), but when the controller 94 determines that the operation is not the regeneration target operation (YES), the target selector valve opening computation section 94*j* sets the target opening amount Aswv for the selector valve 36 to fully closed (step S411).

After step S403 or step S411, the target selector valve opening computation section 94*j* of the controller 94 outputs a command signal according to the target opening amount Aswv to the solenoid proportional valve 93*h* for the selector valve 36 (S404), causes the solenoid proportional valve 93*h* to generate pilot command pressure for the selector valve 36 (S405), and causes the selector valve 36 to open according to the pilot command pressure (S406). Then, the controller 94 ends the processing. Consequently, when the selector valve 36 is opened at the time of arm dumping, a hydraulic working fluid on the bottom side of the arm cylinder 205*a* is discharged, but when the selector valve 36 is closed at the time of arm crowding, a hydraulic working fluid on the rod side of the arm cylinder 205*a* is supplied to the bottom side via the regeneration valve 35.

(2) Operation

The operation of the hydraulic drive system 400 is described specifically in regard to an operation relating to the second hydraulic pump 2. Since operations relating to the other hydraulic pumps are similar to this operation, redundant description is omitted.

(2-1) Operation in State in which Automatic Control Function is Invalid

Operations of the components when the arm operation lever 95*b* is operated in a state in which the automatic control function is invalid are described.

Directional Control Valve

The controller 94 calculates a target opening amount Ams for the first arm directional control valve 11 according to an input amount of the arm operation lever 95*b* and outputs a command signal according to the target opening amount Ams to the solenoid proportional valves 93*d* and 93*e*. The solenoid proportional valves 93*d* and 93*e* generate pilot command pressure PiAm1U and pilot command pressure PiAm1D according to the command signal to control the opening amount of the first arm directional control valve 11.

Auxiliary Flow Rate Control Valve

The controller 94 calculates a target opening amount Afcv_M for the auxiliary flow rate control valve 25 (main valve 33) according to an input amount of the arm operation lever 95*b* and outputs a command signal according to the target opening amount Afcv_M to the solenoid proportional valve 93*g*. The solenoid proportional valve 93*g* generates pilot command pressure according to the command signal to control the opening amount of the auxiliary flow rate control valve 25 (main valve 33). In the present operation example, the auxiliary flow rate control valve 25 (main valve 33) is controlled so as to be fully opened.

Hydraulic Pump

The controller 94 calculates a target flow rate Qpmp_M for the second hydraulic pump 2 according to an input amount of the arm operation lever 95*b* and outputs a command signal according to the target pump flow rate Qpmp_M to the solenoid proportional valve 93*a*. The solenoid proportional valve 93*a* generates flow rate control command pressure PiP2 according to the command signal to control the flow rate in the second hydraulic pump 2.

Selector Valve

The controller 94 determines, on the basis of an input amount of the arm operation lever 95*b*, whether or not the operation is the reproduction target operation, and when the determination result is YES, the controller 94 sets the target opening amount Aswv for the selector valve 36 to fully closed, but when the determination result is NO, the controller 94 sets the target opening amount Aswv to full open. Then, the controller 94 outputs a command signal according to the target opening amount Aswv to the solenoid proportional valve 93*h*. The solenoid proportional valve 93*h* generates pilot command pressure according to the command signal to control the opening amount of the selector valve 36.

(2-2) Operation in State in which Automatic Control Function is Valid

Operations of the components when the arm operation lever 95*b* is operated in a state in which the automatic control function is valid are described.

Directional Control Valve

The controller 94 calculates a target opening amount Ams for the first arm directional control valve 11 according to an input amount of the arm operation lever 95*b* and outputs a command signal according to the target opening amount Ams to the solenoid proportional valves 93*d* and 93*e*. The solenoid proportional valves 93*d* and 93*e* generate pilot command pressure PiAm1U and pilot command pressure PiAm1D according to the command signal to control the opening amount of the first arm directional control valve 11.

Auxiliary Flow Rate Control Valve

The controller 94 calculates a target actuator flow rate Qref and a regeneration flow rate Qreg on the basis of an input amount of the arm operation lever 95*b*, posture information of the machine body 202 or the work device 203, designed face information, and pressure sensor output values. Then, the controller 94 subtracts the regeneration flow rate Qreg from the target actuator flow rate Qref to calculate a target actuator supply flow rate Qact_A, calculates a target opening amount Afcv_A for the auxiliary flow rate control valve 25 (main valve 33) on the basis of the target actuator supply flow rate Qact_A and the fore-and-aft differential pressure ΔPfcv across the auxiliary flow rate control valve 25 (main valve 33), and outputs a command signal according to the target opening amount Afcv_A to the solenoid proportional valve 93*g*. The solenoid proportional valve 93*g* generates pilot command pressure according to the command signal to control the opening amount of the auxiliary flow rate control valve 25 (main valve 33).

Hydraulic Pump

The controller 94 adds up the target supply flow rates Qact_A for the respective actuators to calculate a target pump flow rate Qpmp_A and outputs a command signal according to the target pump flow rate Qpmp_A to the solenoid proportional valve 93*a*. The solenoid proportional valve 93*a* generates flow rate control command pressure PiP2 according to the command signal to control the flow rate in the second hydraulic pump 2. It is to be noted that, since the present operation is stand-alone operation of the arm cylinder 205*a*, the target pump flow rate Qpmp_A is equal to the target supply flow rate Qact_A for the arm cylinder 205*a*.

Selector Valve

The controller 94 determines, on the basis of an input amount of the arm operation lever 95*b*, whether or not the regeneration function is valid, and when the determination result is YES, the controller 94 sets the target opening amount Aswv for the selector valve 36 to fully closed, but when the determination result is NO, the controller 94 sets the target opening amount Aswv to full open. Then, the controller 94 outputs a command signal according to the target opening amount Aswv to the solenoid proportional valve 93*h*. The solenoid proportional valve 93*h* generates pilot command pressure according to the command signal to control the opening amount of the selector valve 36.

(3) Advantageous Effects

In the present embodiment, the work machine 300 includes the machine body 202, the work device 203 mounted on the machine body 202, the actuators 204*a*, 205*a*, 206*a*, and 211 that drive the machine body 202 or the work device 203, the hydraulic working fluid tank 5, the hydraulic pumps 1 to 3 that suck a hydraulic working fluid from the hydraulic working fluid tank 5 and that supply the hydraulic working fluid to the actuators 204*a*, 205*a*, 206*a*, and 211, the directional control valves 6 to 16 and 21 to 29 that are connected in parallel to the delivery lines 40, 50, and 60 of the hydraulic pumps 1 to 3 and that control the flow of a hydraulic fluid to be supplied from the hydraulic pumps 1 to 3 to the actuators 204*a*, 205*a*, 206*a*, and 211, the operation levers 95*a* and 95*b* that give instructions for the operations of the actuators 204*a*, 205*a*, 206*a*, and 211, and the controller 94 that controls the directional control valves 6 to 16 and 21 to 29 according to an input amount of the boom operation levers 95*a* and 95*b*. The work machine 300 further includes the regeneration valve 35 that allows a hydraulic working fluid to flow from the meter-out side to the meter-in side of the flow rate control valve 11, and the selector valve 36 that is provided on the tank line 70 connecting the directional control valve 11 and the hydraulic working fluid tank 5 to each other and that opens or interrupts the tank line 70. The controller 94 is configured to calculate a target actuator flow rate Qref that is a target flow rate for the actuators 204*a*, 205*a*, 206*a*, and 211, on the basis of an input amount of the operation levers 95*a* and 95*b*, calculate a regeneration flow rate Qreg that is a passage flow rate Qreg of a hydraulic fluid passing through the regeneration valve 35, on the basis of the input amount of the operation levers 95*a* and 95*b* and the target actuator flow rate Qref, subtract the regeneration flow rate Qreg from the target actuator flow rate Qref to calculate a target actuator supply flow rate Qact_A, calculate a target opening amount Afcv_A for the flow rate control valve on the basis of the target actuator supply flow rate Qact_A, calculate a target pump flow rate Qpmp-A that is equal to or higher than the total target actuator supply flow rate Afcv_A, control the selector valve 36 on the basis of the input amount of the operation levers 95*a* and 95*b*, control the auxiliary flow rate control valves 21 to 29 according to the target opening amount Afcv_A for the flow rate control valve, and control the hydraulic pumps 1 to 3 according to the target pump flow rate Qpmp_A.

Further, the directional control valves 6 to 16 and 21 to 29 include the directional control valves 6 to 16 that control a direction of a hydraulic fluid to be supplied from the hydraulic pumps 1 to 3 to the actuators 204*a*, 205*a*, 206*a*, and 211, and the auxiliary flow rate control valves 21 to 29 that restrict the flow rate of a hydraulic fluid to be supplied from the hydraulic pumps 1 to 3 to the meter-in ports of the directional control valves 6 to 16. The regeneration valve 35 is arranged on the hydraulic line that connects the meter-out port and the meter-in port of the directional control valve 11 to each other.

According to the present working example configured in such a manner as described above, the auxiliary flow rate control valves 21 to 29 and the hydraulic pumps 1 to 3 are controlled such that the total of the target flow rate of a hydraulic fluid to be supplied from the hydraulic pumps 1 to 3 to the actuators (target actuator supply flow rate Qact_A) and the regeneration flow rate Qreg in the actuators becomes equal to the target flow rate for the actuators (target actuator flow rate Qref). Consequently, while the position control accuracy of the actuators is secured, the operation speed of the actuators can be increased by the regeneration function. Thus, the work efficiency of the work machine 100 can be improved. Further, by closing the selector valve 36 upon regeneration, the full amount of the return flow rate in the actuators can be regenerated with certainty. Moreover, since the regeneration flow rate coincides with the return flow rate in the actuators, control of the regeneration flow rate based on the fore-and-aft differential pressure across the regeneration valve 35 becomes unnecessary. By making the operation of the selector valve 36 simple as an ON/OFF operation, the pressure sensor for detecting the differential pressure across the regeneration valve 35 becomes unnecessary, and therefore, the configuration of the hydraulic drive system 400 can be simplified.

Further, the work machine 300 according to the present working example includes the automatic control function changeover switch 96 that gives an instruction for validation or invalidation of the automatic control function of the machine body 202 or the work device 203. When a an instruction for invalidation of the automatic control function is given from the automatic control function changeover switch 96, the controller 94 calculates a target opening amount Afcv_M for the flow rate control valve and a target pump flow rate Qpmp_M on the basis of an input amount of the operation levers 95*a* and 95*b*. Consequently, when the automatic control function is invalidated, the operation speed of the actuators can be increased by the regeneration function similarly to a conventional work machine.

Second Working Example

Figure 8A:
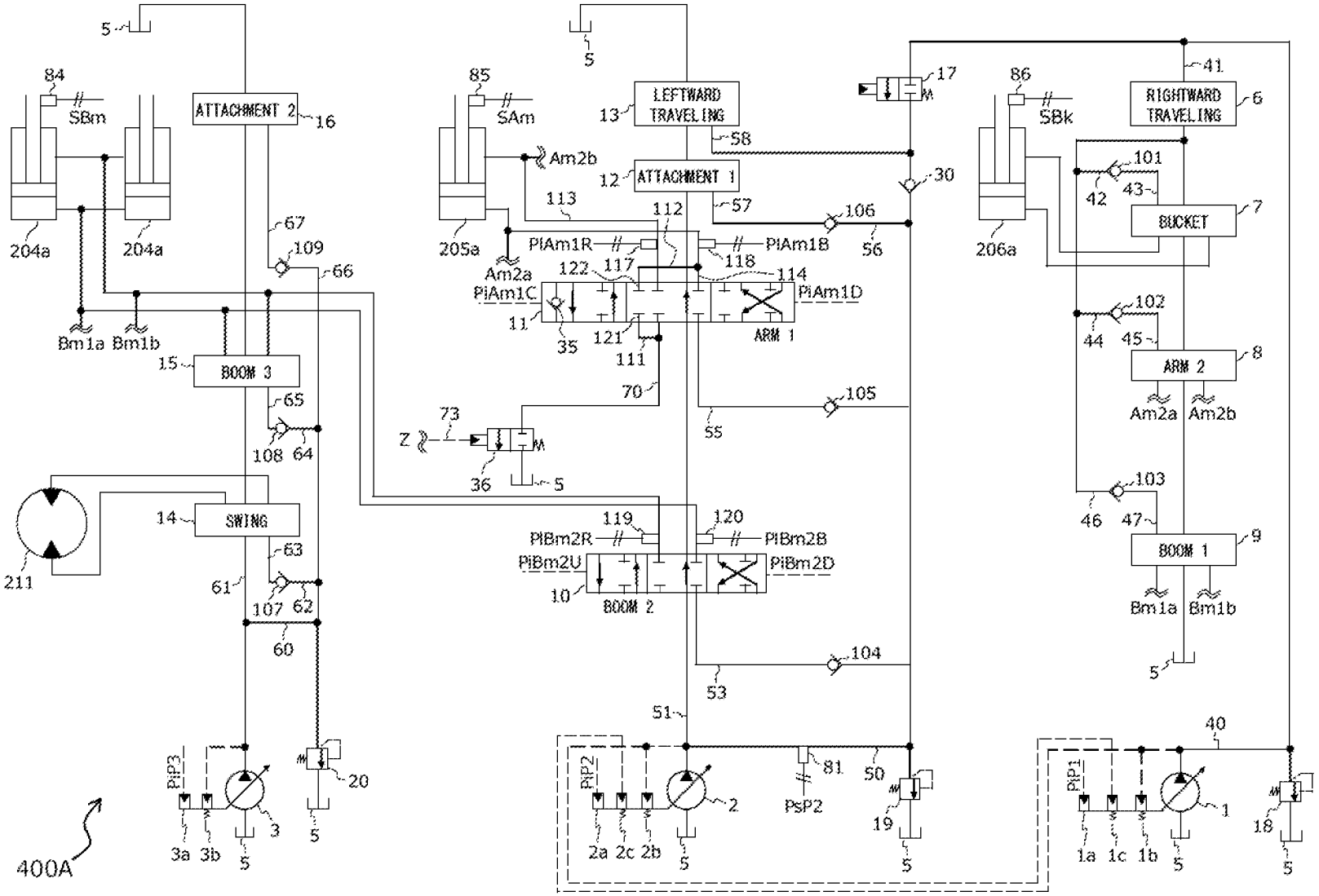
FIG. 8A is a circuit diagram (1/2) of a hydraulic drive system according to a second working example of the present invention.
Figure 8B:
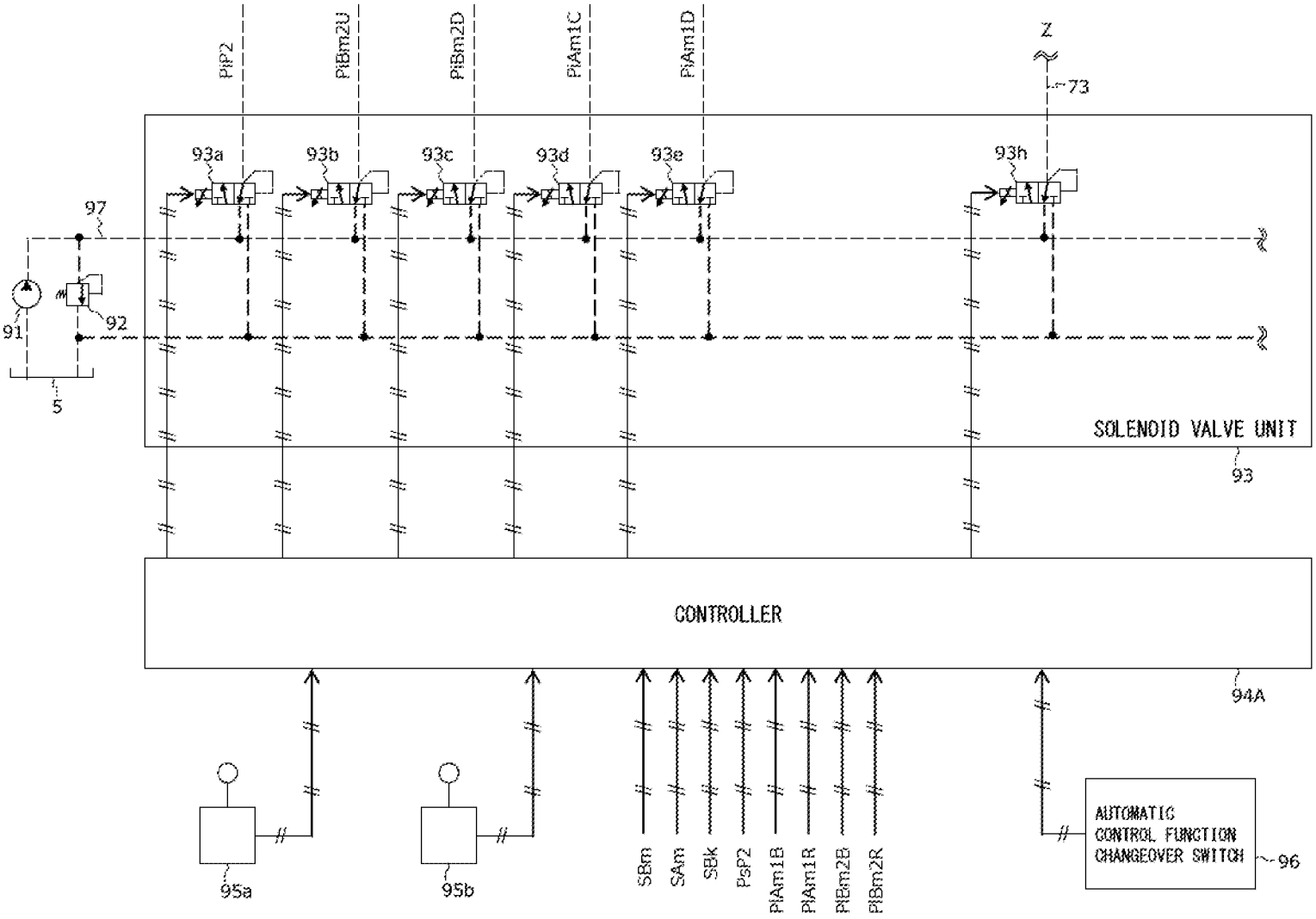
FIG. 8B is a circuit diagram (2/2) of the hydraulic drive system according to the second working example of the present invention.

FIGS. 8A and 8B are circuit diagrams of a hydraulic drive system according to a second working example of the present invention.

(1) Configuration

The configuration of a hydraulic drive system 400A according to the present working example is substantially similar to that of the hydraulic drive system 400 (depicted in FIGS. 2A and 2B) according to the first working example, but the hydraulic drive system 400A and the hydraulic drive system 400 are different in the following features.

The hydraulic drive system 400A according to the present working example includes, in place of the auxiliary flow rate control valves 21 to 29 in the first working example, check valves 101 to 109 for preventing backflow from the actuator side to the delivery lines 40, 50 and 60.

The regeneration valve 35 in the present working example is arranged in the inside of the spool of the first arm directional control valve 11, and regeneration ports 121 and 122 are provided in the first arm directional control valve 11. To the regeneration port 121, a hydraulic line 111 branching from a tank line 70 connected to the meter-out port of the first arm directional control valve 11 is connected. To the regeneration port 122, a hydraulic line 112 branching from the hydraulic line 114 that connects the first arm directional control valve 11 and the bottom side of the arm cylinder 205*a* to each other is connected. When a switching operation is performed on the spool of the first arm directional control valve 11 in the crowding direction (rightward direction in FIGS. 8A and 8B), the hydraulic line 111 is connected to the upstream side of the regeneration valve 35, and the hydraulic line 112 is connected to the downstream side of the regeneration valve 35. Consequently, a hydraulic working fluid discharged from the rod side of the arm cylinder 205*a* is supplied to the bottom side via the regeneration valve 35. Pressure sensors 117 and 118 are respectively provided on the hydraulic lines 113 and 114 that connect the first arm directional control valve 11 and the arm cylinder 205*a* to each other. It is to be noted that, although illustration is partly omitted in order to simplify the description, the directional control valves 6 to 16 and their peripheral components, pipes, and wires are all the same in configuration.

Figure 9:
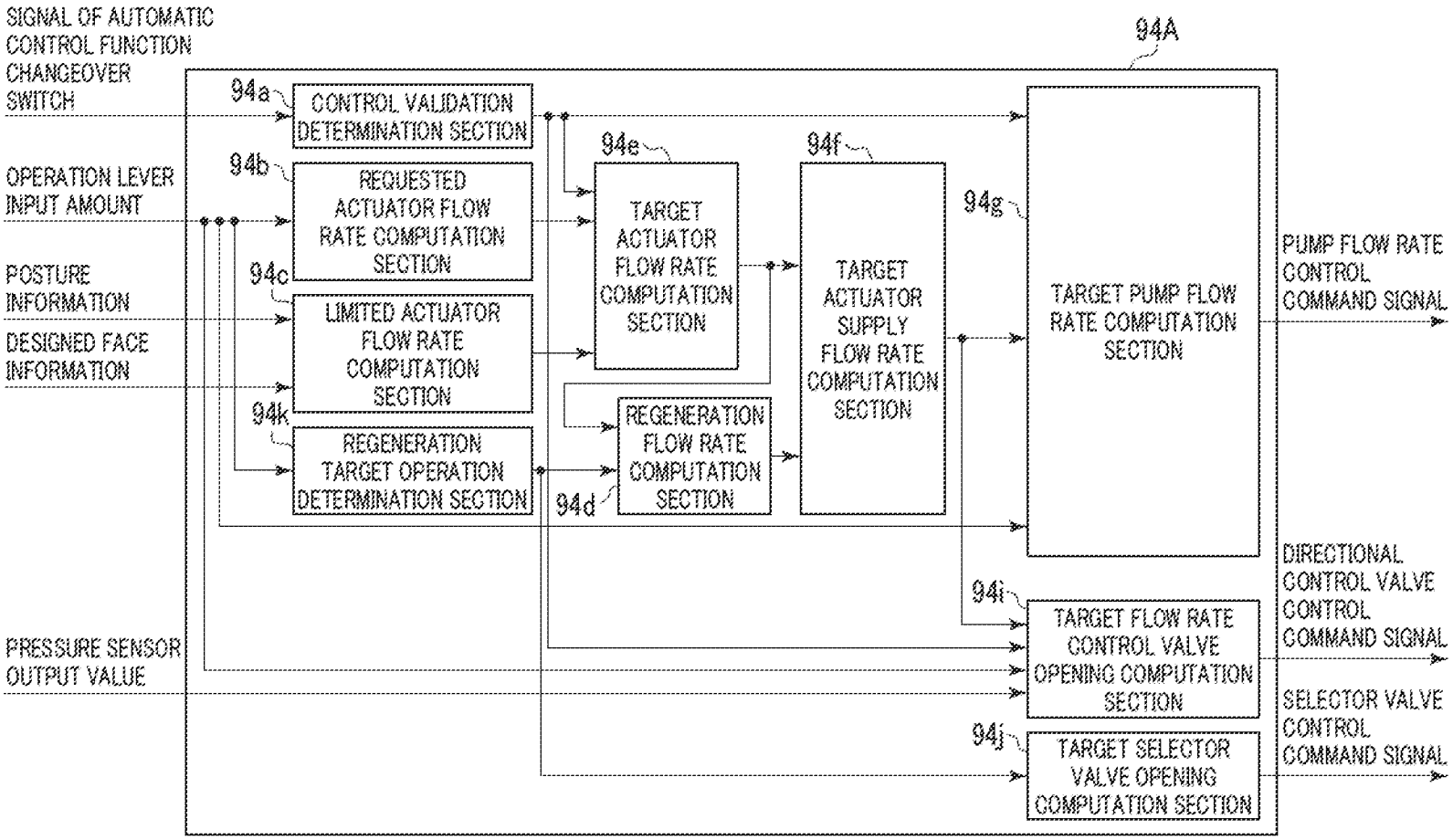
FIG. 9 is a functional block diagram of a controller in the second working example of the present invention.

FIG. 9 is a functional block diagram of a controller 94A in the present working example. Referring to FIG. 9, the controller 94A in the present working example includes a target directional control valve opening computation section 94*l* in place of the target directional control valve opening computation section 94*h* and the target flow rate control valve opening computation section 94*i* (depicted in FIG. 3) in the first working example. The target directional control valve opening computation section 94*l* calculates a target opening amount for the directional control valves 6 to 16 on the basis of a result of determination from the control validation determination section 94*a*, a target actuator supply flow rate from the target actuator supply flow rate computation section 94*f*, an operation lever input amount, and pressure sensor output values, and outputs a command signal (directional control valve control command signal) according to the target opening amount.

Figure 10:
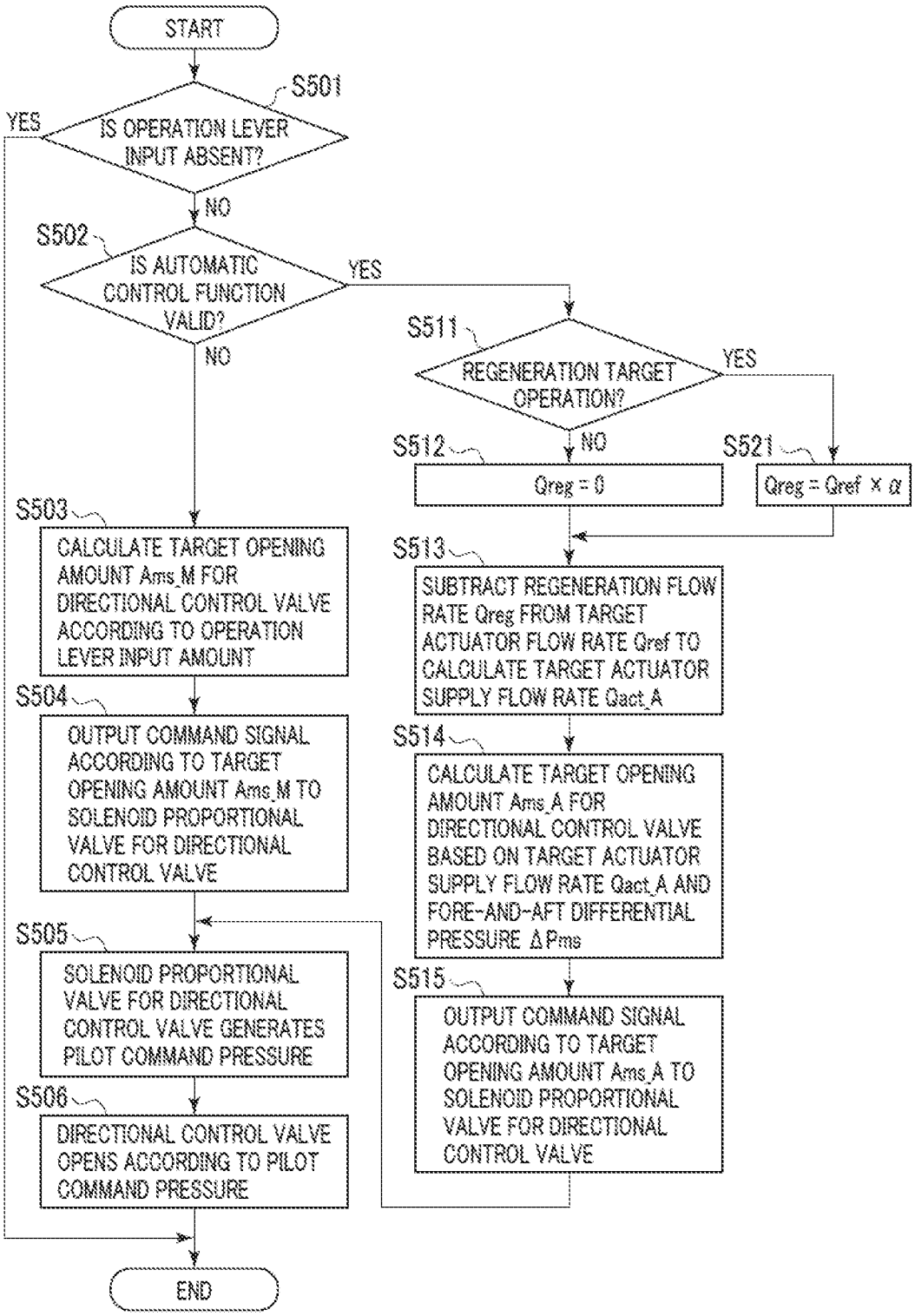
FIG. 10 is a flow chart depicting processing relating to control of a directional control valve by the controller in the second working example of the present invention.

FIG. 10 is a flow chart depicting processing relating to control of the directional control valves 6 to 16 by the controller 94A. In the following, only processing relating to control of the first arm directional control valve 11 is described. Since processing relating to control of the other directional control valves is similar to the processing relating to the control of the first arm directional control valve 11, redundant description is omitted.

The controller 94 first determines whether or not an input of the arm operation lever 95*b* is absent (step S501). When it is determined in step S501 that an input of the arm operation lever 95*b* is absent (YES), the controller 94 ends the processing. When it is determined in step S501 that an input of the arm operation lever 95*b* is present (NO), the controller 94 determines whether or not the automatic control function (machine control) is valid (step S502).

When it is determined in step S502 that the automatic control function is invalid (NO), the target flow rate control valve opening computation section 94*i* of the controller 94 calculates a target opening amount Ams_M for the directional control valve 11 according to the input amount of the arm operation lever 95*b* (step S503), outputs a command signal according to the target opening amount Ams_M to the solenoid proportional valves 93*d* and 93*e* for the directional control valve 11 (S504), causes the solenoid proportional valves 93*d* and 93*e* to generate pilot command pressure for the directional control valve 11 (S505), and causes the directional control valve 11 to open according to the pilot command pressure (S506). Then, the controller 94 ends the processing.

When it is determined in step S502 that the automatic control function is valid (YES), the regeneration target operation determination section 94*k* of the controller 94 determines, on the basis of the input amount of the arm operation lever 95*b*, whether or not the operation is the reproduction target operation (step S511). In the present working example, when the arm operation lever 95*b* is operated in the arm crowding direction, the regeneration target operation determination section 94*k* determines that the operation is the regeneration target operation (YES), but when the arm operation lever 95*b* is operated in the arm dumping direction, the regeneration target operation determination section 94*k* determines that the operation is not the regeneration target operation (NO).

When it is determined in step S511 that the operation is not the reproduction target operation (NO), the regeneration flow rate computation section 94*d* of the controller 94 sets the regeneration flow rate Qreg to zero (step S512), but when it is determined that the operation is the reproduction operation (YES), the regeneration flow rate computation section 94*d* multiplies the target actuator flow rate Qreg by a meter-in meter-out flow rate $\alpha$ to calculate a regeneration flow rate Qreg (step S521).

After step S512 or step S521, the target actuator supply flow rate computation section 94*f* of the controller 94 subtracts the regeneration flow rate Qreg from the target actuator flow rate Qref to calculate a target actuator supply flow rate Qact_A (step S513), and the target flow rate control valve opening computation section 94*i* of the controller 94 calculates a target opening amount Ams_A for the directional control valve 11 on the basis of the target actuator supply flow rate Qact_A and the fore-and-aft differential pressure $\Delta$Pms across the directional control valve 11 (step S514), and outputs a command signal according to the target opening amount Ams_A to the solenoid proportional valves 93*d* and 93*e* for the directional control valve 11 (step S515). Then, after the controller 94 executes the processing in steps S505 and S506, it ends the processing.

(2) Operation

The operation of the hydraulic drive system 400A in the second working example is described specifically in regard to an operation relating to the second hydraulic pump 2. Since operations relating to the other hydraulic pumps are similar to the operation, redundant description is omitted.

(2-1) Operation in State in which Automatic Control Function is Invalid

Operations of the components when the arm operation lever 95*b* is operated in a state in which the automatic control function is invalid are described.

Directional Control Valve

The controller 94A calculates a target opening amount Ams_M for the first arm directional control valve 11 according to an input amount of the arm operation lever 95*b* and outputs a command signal according to the target opening amount Ams_M to the solenoid proportional valves 93*d* and 93*e*. The solenoid proportional valves 93*d* and 93*e* generate pilot command pressure PiAm1U and pilot command pressure PiAm1D according to the command signal to control the opening amount of the first arm directional control valve 11.

Hydraulic Pump

Since the operation of the hydraulic pump is similar to that in the first working example, description of it is omitted.

Selector Valve

Since the operation of the selector valve is similar to that in the first working example, description of it is omitted.

(2-2) Operation in State in which Automatic Control Function is Valid

Operations of the components when the arm operation lever 95*b* is operated in a state in which the automatic control function is valid are described.

Directional Control Valve

The controller 94A calculates a target actuator flow rate Qref and a regeneration flow rate Qreg on the basis of an input amount of the arm operation lever 95*b*, posture information of the machine body 202 or the work device 203, designed face information, and pressure sensor output values, subtracts the regeneration flow rate Qreg from the target actuator flow rate Qref to calculate a target actuator supply flow rate Qact_A, calculates a target opening amount Ams_A for the directional control valve 11 on the basis of the target actuator supply flow rate Qact_A and the fore-and-aft differential pressure ΔPms across the directional control valve 11, and outputs a command signal according to the target opening amount Ams_A to the solenoid proportional valves 93*d* and 93*e*. The solenoid proportional valves 93*d* and 93*e* generate pilot command pressure PiAm1U and pilot command pressure PiAm1D according to the command signal to control the opening amount of the directional control valve 11.

Hydraulic Pump

Since the operation of the hydraulic pump is similar to that in the first working example, description of it is omitted.

Selector Valve

Since the operation of the selector valve is similar to that in the first working example, description of it is omitted.

(3) Advantageous Effects

In the second working example, the directional control valves 6 to 16, which control the flow of a hydraulic fluid that is to be supplied from the hydraulic pumps 1 to 3 to the actuators 204*a*, 205*a*, 206*a*, and 211, are directional control valves that control the direction and the flow rate of a hydraulic fluid to be supplied from the hydraulic pumps 1 to 3 to the actuators 204*a*, 205*a*, 206*a*, and 211. The regeneration valve 115 is arranged in the inside of the spool of the directional control valve 11.

According to the second working example configured in such a manner as described above, the operation speed of the actuators can be increased by the regeneration function while the position control accuracy of the actuators is secured, with a simpler configuration than that in the first working example. Consequently, the work efficiency of the work machine 100 can be improved while the cost is suppressed.

Although the working examples of the present invention have been described in detail, the present invention is not limited to the working examples described above and includes various modifications. For example, the working examples described above have been described in detail in order to explain the present invention in an easy-to-understand manner and are not necessarily limited to what includes all configurations described hereinabove. Also, it is possible to add part of the configuration of a certain working example to the configuration of a different working example, and it is also possible to delete part of the configuration of a certain working example or replace part of the configuration of a certain working example with part of a different working example.

DESCRIPTION OF REFERENCE CHARACTERS

1: First hydraulic pump
1*a*: Flow rate control command pressure port (regulator)
1*b*: First hydraulic pump self-pressure port (regulator)
1*c*: Second hydraulic pump self-pressure port (regulator)
2: Second hydraulic pump
2*a*: Flow rate control command pressure port (regulator)
2*b*: Second hydraulic pump self-pressure port (regulator)
2*c*: First hydraulic pump self-pressure port (regulator)
3: Third hydraulic pump
3*a*: Flow rate control command pressure port (regulator)
3*b*: Third hydraulic pump self-pressure port (regulator)
5: Hydraulic working fluid tank
6: Rightward traveling directional control valve (flow rate control valve)
7: Bucket directional control valve (flow rate control valve)
8: Second arm directional control valve (flow rate control valve)
9: First boom directional control valve (flow rate control valve)
10: Second boom directional control valve (flow rate control valve)
11: First arm directional control valve (flow rate control valve)
12: First attachment directional control valve (flow rate control valve)
13: Leftward traveling directional control valve (flow rate control valve)
14: Swinging directional control valve (flow rate control valve)
15: Third boom directional control valve (flow rate control valve)
16: Second attachment directional control valve (flow rate control valve)
17: Merge valve
18 to 20: Main relief valve
21 to 29: Auxiliary flow rate control valve (flow rate control valve)
30: Check valve
31: Main valve
31*a*: Valve body
31*b*: Control variable restrictor
31*c*: First pressure chamber
31*d*: Second pressure chamber
31*e*: Third pressure chamber
32: Pilot variable restrictor
32*a*: Pilot port
33: Main valve
33*a*: Valve body
33*b*: Control variable restrictor
33*c*: First pressure chamber
33*d*: Second pressure chamber
33*e*: Third pressure chamber
34: Pilot variable restrictor
34*a*: Pilot port
35: Regeneration valve
36: Selector valve
41: Center bypass line
42 to 47: Hydraulic line
51: Center bypass line
52 to 58: Hydraulic line
61: Center bypass line
62 to 69: Hydraulic line
70: Tank line
71 to 75: Hydraulic line
81 to 83: Pressure sensor
84 to 86: Stroke sensor
91: Pilot pump
92: Pilot relief valve
93: Solenoid valve unit
93*a* to 93*h*: Solenoid proportional valve
94, 94A: Controller
94*a*: Control validation determination section

94*b*: Requested actuator flow rate computation section
94*c*: Limited actuator flow rate computation section
94*d*: Regeneration flow rate computation section
94*e*: Target actuator flow rate computation section
94*f*: Target actuator supply flow rate computation section
94*g*: Target pump flow rate computation section
94*h*: Target Directional control valve opening computation section
94*i*: Target flow rate control valve opening computation section
94*j*: Target selector valve opening computation section
94*k*: Regeneration target operation determination section
94*l*: Target directional control valve opening computation section
95*a*: Boom operation lever
95*b*: Arm operation lever
96: Automatic control function changeover switch
97: Hydraulic line
101 to 109: Check valve
111 to 114: Hydraulic line
117 to 120: Pressure sensor
121, 122: Regeneration port
201: Track structure
202: Swing structure (machine body)
203: Work device
204: Boom
204*a*: Boom cylinder (actuator)
205: Arm
205*a*: Arm cylinder (actuator)
206: Bucket
206*a*: Bucket cylinder (actuator)
207: Operation room
208: Machine room
209: Counterweight
210: Control valve
211: Swing motor (actuator)
300: Hydraulic excavator (work machine)
400, 400A: Hydraulic drive system

The invention claimed is:

1. A work machine comprising:
a machine body;
a work device mounted on the machine body;
an actuator that drives the machine body or the work device;
a hydraulic working fluid tank;
a hydraulic pump that sucks a hydraulic working fluid from the hydraulic working fluid tank and supplies the hydraulic working fluid to the actuator;
a flow rate control valve that is connected in parallel to a delivery line of the hydraulic pump and controls a flow of a hydraulic fluid to be supplied from the hydraulic pump to the actuator;
an operation lever that gives an instruction for an operation of the actuator; and
a controller that controls the flow rate control valve according to an input amount of the operation lever, wherein
the work machine includes
a regeneration valve that allows a hydraulic working fluid to flow from a meter-out side to a meter-in side of the flow rate control valve, and
a selector valve that is provided on a tank line connecting the flow rate control valve and the hydraulic working fluid tank to each other and opens or interrupts the tank line, and
the controller is configured to
calculate a target actuator flow rate that is a target flow rate for the actuator, on the basis of the input amount of the operation lever,
calculate a regeneration flow rate that is a flow rate of a hydraulic fluid passing through the regeneration valve, on the basis of the input amount of the operation lever and the target actuator flow rate,
subtract the regeneration flow rate from the target actuator flow rate to calculate a target actuator supply flow rate,
calculate a target flow rate control valve opening amount on the basis of the target actuator flow rate,
calculate a target pump flow rate that is equal to or higher than a total target actuator supply flow rate,
control the selector valve on the basis of the input amount of the operation lever,
control the flow rate control valve according to the target flow rate control valve opening amount, and
control the hydraulic pump according to the target pump flow rate.

2. The work machine according to claim 1, wherein
the flow rate control valve includes
a directional control valve that controls a direction of a hydraulic fluid to be supplied from the hydraulic pump to the actuator, and
an auxiliary flow rate control valve that restricts a flow rate of a hydraulic fluid to be supplied from the hydraulic pump to a meter-in port of the directional control valve, and
the regeneration valve is arranged on a hydraulic line that connects a meter-out port and the meter-in port of the directional control valve to each other.

3. The work machine according to claim 1, wherein
the flow rate control valve is a directional control valve that controls a direction and a flow rate of a hydraulic fluid to be supplied from the hydraulic pump to the actuator, and
the regeneration valve is arranged inside a spool of the directional control valve.

4. The work machine according to claim 1, wherein
the work machine includes an automatic control function changeover switch that gives an instruction for validation or invalidation of an automatic control function of the machine body or the work device, wherein
the controller is configured to, in a case where an instruction for invalidation of the automatic control function is given from the automatic control function changeover switch, calculate the target flow rate control valve opening amount and the target pump flow rate on the basis of the input amount of the operation lever.

* * * * *